US009037068B2

(12) United States Patent
Kojima

(10) Patent No.: US 9,037,068 B2
(45) Date of Patent: May 19, 2015

(54) IMAGE FORMING APPARATUS AND PROCESS CARTRIDGE INCLUDING CLEANING BLADE

(71) Applicant: FUJI XEROX CO., LTD., Tokyo (JP)

(72) Inventor: Noriaki Kojima, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 71 days.

(21) Appl. No.: 13/788,581

(22) Filed: Mar. 7, 2013

(65) Prior Publication Data

US 2014/0086654 A1 Mar. 27, 2014

(30) Foreign Application Priority Data

Sep. 25, 2012 (JP) ..... 2012-210547

(51) Int. Cl.
*G03G 21/00* (2006.01)
*G03G 21/18* (2006.01)

(52) U.S. Cl.
CPC ..... *G03G 21/0011* (2013.01); *G03G 21/1814* (2013.01); *G03G 21/0017* (2013.01)

(58) Field of Classification Search
CPC ..... G03G 21/0017; G03G 21/0011; G03G 21/1814
USPC ..... 399/252, 350, 351
See application file for complete search history.

(56) References Cited

U.S. PATENT DOCUMENTS

| | | | | |
|---|---|---|---|---|
| 7,415,238 | B2 * | 8/2008 | Watanabe et al. | 399/350 |
| 7,796,934 | B2 * | 9/2010 | Teshigawara | 399/350 |
| 2011/0243624 | A1 * | 10/2011 | Yamamoto et al. | 399/350 |

FOREIGN PATENT DOCUMENTS

| | | |
|---|---|---|
| JP | A-2000-056595 | 2/2000 |
| JP | A-2005-164775 | 6/2005 |
| JP | A-2010-139737 | 6/2010 |

* cited by examiner

*Primary Examiner* — Sandra Brase
(74) *Attorney, Agent, or Firm* — Oliff PLC

(57) ABSTRACT

An image forming apparatus includes an image holding member, a developing device which accommodates a toner which contains at least one type of external additive having an average particle size of 0.02 μm or greater, and toner particles having a surface with the external additive externally added thereto, and forms an image developed with the toner on a surface of the image holding member, a transfer device which transfers the developed image formed on the image holding member onto a recording medium, and a cleaning device which is provided with a cleaning blade constituted by a member in which at least a part which is brought into contact with the image holding member has a dynamic micro hardness of from 0.25 to 0.65, and brings the cleaning blade into contact with the surface of the image holding member after transfer of the developed image to perform cleaning.

2 Claims, 6 Drawing Sheets

IMAGE FORMING APPARATUS AND PROCESS CARTRIDGE INCLUDING CLEANING BLADE

CROSS-REFERENCE TO RELATED APPLICATIONS

This application is based on and claims priority under 35 USC 119 from Japanese Patent Application No. 2012-210547 filed Sep. 25, 2012.

BACKGROUND (i) Technical Field

The present invention relates to an image forming apparatus, and a process cartridge.

(ii) Related Art

Hitherto, cleaning blades have been used as cleaners for removing a toner and the like remaining on a surface of an image holding member such as a photoreceptor in electrophotographic copiers, printers, fax machines, and the like.

SUMMARY

According to an aspect of the invention, there is provided an image forming apparatus including an image holding member, a developing device which accommodates a toner which contains at least one type of external additive having an average particle size of 0.02 μm or greater, selected from metallic soap particles and inorganic particles having an oil-treated surface, and toner particles having a surface with the external additive externally added thereto, and forms an image developed with the toner on a surface of the image holding member, a transfer device which transfers the developed image formed on the image holding member onto a recording medium, and a cleaning device which is provided with a cleaning blade constituted by a member in which at least a part which is brought into contact with the image holding member has a dynamic micro hardness of from 0.25 to 0.65, in which a maximum length of an area which is brought into contact with the image holding member in a driving direction of the image holding member is from 1 μm to 300 μm, and brings the cleaning blade into contact with the surface of the image holding member after transfer of the developed image by the transfer device to perform cleaning.

BRIEF DESCRIPTION OF THE DRAWINGS

Exemplary embodiments of the present invention will be described in detail based on the following figures, wherein.

DETAILED DESCRIPTION

Figure 1:
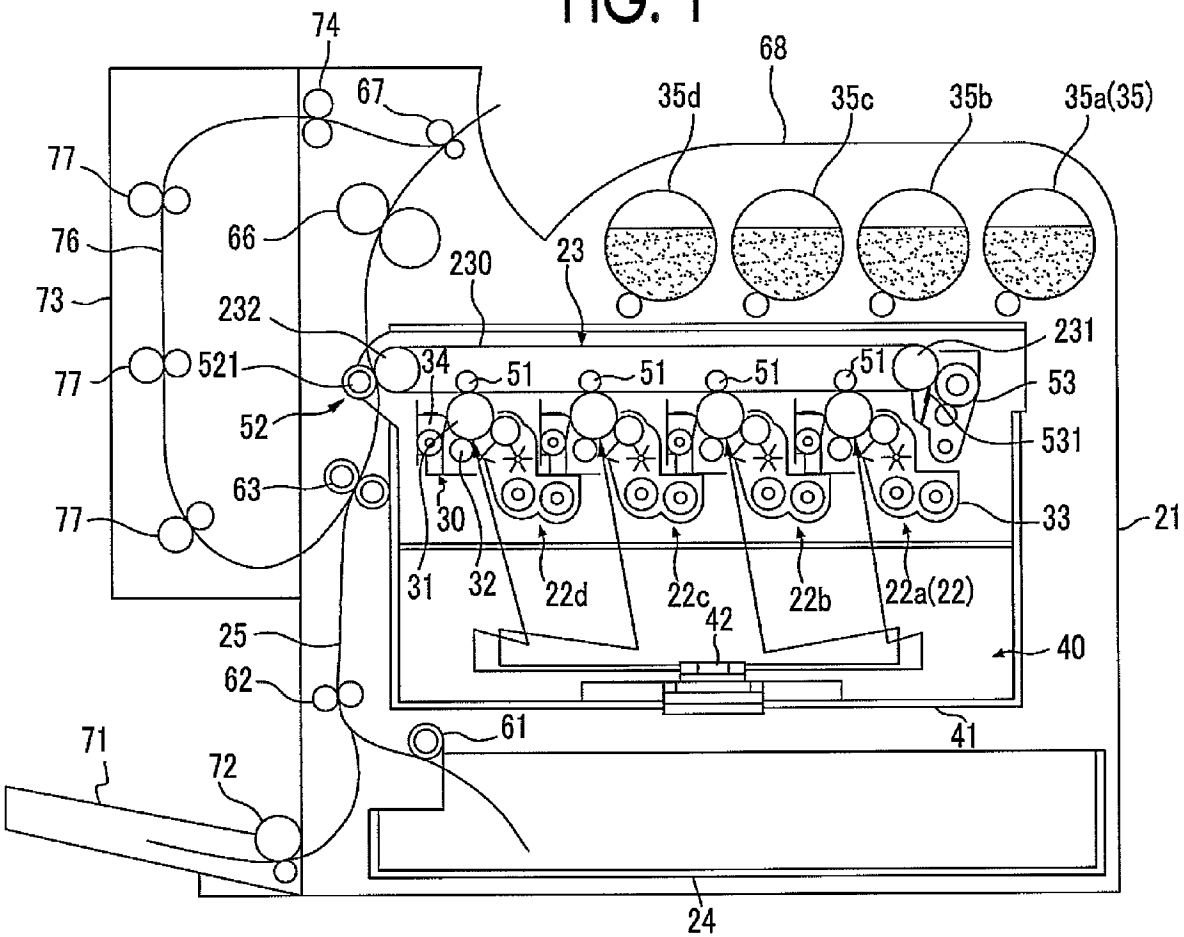
FIG. 1 is a schematic diagram showing an example of an image forming apparatus according to an exemplary embodiment.

Hereinafter, exemplary embodiments of an image forming apparatus and a process cartridge of the invention will be described in detail.

Image Forming Apparatus and Process Cartridge

An image forming apparatus according to an exemplary embodiment is provided with an image holding member, a developing device, a transfer device, and a cleaning device.

The developing device accommodates a toner and forms an image developed with the toner on a surface of the image holding member. The toner contains at least one type of external additive having an average particle size of 0.02 μm or greater, selected from metallic soap particles and inorganic particles having an oil-treated surface, and toner particles having a surface with the external additive externally added thereto.

The transfer device transfers the developed image formed on the image holding member onto a recording medium.

The cleaning device performs cleaning by bringing a cleaning blade into contact with the surface of the image holding member after transfer of the developed image by the transfer device. The cleaning blade is constituted by a member in which at least a part which is brought into contact with the image holding member has a dynamic micro hardness of from 0.25 to 0.65, and the maximum length (hereinafter, also simply referred to as "tuck amount") of the area which is brought into contact with the image holding member in a driving direction of the image holding member is from 1 μm to 300 μm.

In addition, the process cartridge according to the exemplary embodiment is detachable from the image forming apparatus, and is provided with the image holding member, the developing device, and the cleaning device.

Hitherto, in cleaning blades which clean surfaces of image holding members in image forming apparatuses, in some cases, chips have occurred in a part which is brought into contact with the image holding member, and slipping of materials such as a toner adhering to the surface of the image holding member have occurred at positions at which the chips have occurred. Therefore, it is preferable to suppress the occurrence of chips in the cleaning blade.

On the other hand, in the exemplary embodiment, a part of the cleaning blade, which is brought into contact with the image holding member, is constituted by a member having a dynamic micro hardness in the above range, and the tuck amount is adjusted in the above range. Here, "tuck amount" represents a maximum length of the area which is brought into contact with the image holding member in the driving direction in a state in which kinetic friction occurs in the part in which the cleaning blade and the image holding member are brought into contact with each other when the image holding member is driven, and the cleaning blade rolls in the driving direction due to the kinetic friction. The tuck amount is a hardness of the part of the cleaning blade, which is brought into contact with the image holding member, and a numerical value varying due to the frictional force between the cleaning blade and the image holding member (to be described in detail) and the like.

When the cleaning blade satisfies the requirements for the hardness and the tuck amount, the size (the maximum size of a hole when viewed in the driving direction of the image holding member) of chips occurring in the cleaning blade is suppressed. Specifically, the size is suppressed to from 10 μm to 50 μm.

However, in some cases, even when the size of the chips in the cleaning blade is suppressed in the above range, toner slipping occurs due to the reason that toner particles having a particle size smaller than the size of the chips are used, smaller debris are generated due to breaking of toner particles, or the like. Therefore, it is preferable for the image forming apparatus to suppress toner slipping.

On the other hand, in the exemplary embodiment, as a toner which is accommodated in the developing device, a toner to which an external additive having an average particle size in the above range and selected from metallic soap particles and inorganic particles having an oil-treated surface is externally added is used. When an external additive which satisfies the above requirements is applied with respect to chips having a size suppressed in the above range, toner slipping resulting from the chips of the cleaning blade is effectively suppressed, and favorable cleaning performance is obtained.

The reason that the above-described effects are obtained is not clear, but presumed that the external additive isolated from the toner particles is accumulated and forms a dam on the upstream side of the part in which the cleaning blade and the image holding member are brought into contact with each other, and the dam effectively fills a chip when the size of the chip is in the above range, and thus toner slipping is suppressed.

Configurations of Image Forming Apparatus and Process Cartridge

First, configurations of the image forming apparatus and the process cartridge according to the exemplary embodiment will be described in detail using the drawings as examples thereof. However, the configurations of the image forming apparatus and the process cartridge according to the exemplary embodiment are not limited to the aspect shown in FIG. 1.

FIG. 1 is a schematic diagram showing an example of the image forming apparatus according to the exemplary embodiment, which is a so-called tandem image forming apparatus.

In FIG. 1, the reference number 21 represents a body housing, each of the reference numbers 22 and 22*a* to 22*d* represents an imaging engine, the reference number 23 represents a belt module, the reference number 24 represents a recording medium supply cassette, the reference number 25 represents a recording medium transport path, the reference number 30 represents each photoreceptor unit, the reference number 31 represents a photoreceptor drum (a type of image holding member), the reference number 33 represents each developing unit (a type of developing device), the reference number 34 represents a cleaning device, each of the reference numbers 35 and 35*a* to 35*d* represents a toner cartridge, the reference number 40 represents an exposure unit, the reference number 41 represents a unit case, the reference number 42 represents a polygon mirror, the reference number 51 represents a primary transfer device, the reference number 52 represents a secondary transfer device, the reference number 53 represents a belt cleaning device, the reference number 61 represents a delivery roll, the reference number 62 represents a transport roll, the reference number 63 represents a positioning roll, the reference number 66 represents a fixing device, the reference number 67 represents a discharge roll, the reference number 68 represents a paper discharger, the reference number 71 represents a manual supply device, the reference number 72 represents a delivery roll, the reference number 73 represents a two-sided recording unit, the reference number 74 represents a guide roll, the reference number 76 represents a transport path, the reference number 77 represents a transport roll, the reference number 230 represents an intermediate transfer belt, each of the reference numbers 231 and 232 represents a support roll, the reference number 521 represents a secondary transfer roll, and the reference number 531 represents a cleaning blade. The primary transfer device 51, the intermediate transfer belt 230, and the secondary transfer device 52 constitute the transfer device according to the exemplary embodiment.

In the tandem image forming apparatus shown in FIG. 1, the imaging engines 22 (specifically, 22*a* to 22*d*) for four colors (in the exemplary embodiment, black, yellow, magenta, and cyan) are arranged in the body housing 21, and the belt module 23 including the intermediate transfer belt 230 which is circularly transported in the arrangement direction of the respective imaging engines 22 is installed in an upper part in FIG. 1. In the lower part of the body housing 21 in FIG. 1, the recording medium supply cassette 24 which accommodates recording mediums (not shown) such as paper is installed. In addition, the recording medium transport path 25 which becomes a transport path for recording mediums from the recording medium supply cassette 24 is installed in a vertical direction.

In the exemplary embodiment, the respective imaging engines 22 (22*a* to 22*d*) are used to sequentially form, for example, black, yellow, magenta, and cyan (the arrangement is not necessarily limited to this order) toner images from the upstream side of the intermediate transfer belt 230 in the circulation direction, and provided with the photoreceptor units 30 and the developing units 33, respectively, with one common exposure unit 40.

Here, the photoreceptor unit 30 is formed as a sub-cartridge by integrally forming, for example, the photoreceptor drum (image holding member) 31, a charging roll (charging device) 32 which charges the photoreceptor drum 31 in advance, and the cleaning device 34 which removes a toner remaining on the photoreceptor drum 31 with each other.

In addition, the developing unit (developing device) 33 develops an electrostatic latent image formed by exposure by the exposure unit 40 on the charged photoreceptor drum 31 with a corresponding color toner (which has, for example, a negative polarity in the exemplary embodiment). The sub-cartridge constituted by the photoreceptor unit 30 and the developing unit 33 are formed integrally with each other to constitute the process cartridge (so-called Customer Replaceable Unit).

In addition, in FIG. 1, the reference number 35 (35*a* to 35*d*) represents a toner cartridge for replenishing each color-component toner to each developing unit 33 (the toner replenishment path is not shown).

The exposure unit 40 stores, for example, four semiconductor lasers (not shown), one polygon mirror 42, an imaging lens (not shown), and mirrors (not shown) corresponding to the respective photoreceptor units 30 in the unit case 41, and is disposed so that light beams from the semiconductor laser for each color component are deflectively scanned by the polygon mirror 42 and an optical image is guided to an exposure point on the corresponding photoreceptor drum 31 via the imaging lens and the mirror.

In addition, in the exemplary embodiment, the belt module 23 is a belt module in which the intermediate transfer belt 230 is put between the pair of support rolls (one roll is a driving roll) 231 and 232. The primary transfer device (primary transfer roll in this example) 51 is installed on a rear surface of the intermediate transfer belt 230 corresponding to the photoreceptor drums 31 of each of the photoreceptor units 30, and a voltage whose polarity is opposite the charging polarity of the toner is applied to the primary transfer device 51 to electrostatically transfer the toner image on the photoreceptor drum 31 onto the intermediate transfer belt 230.

Furthermore, the secondary transfer device 52 is installed on a site corresponding to the support roll 232 on the downstream side of the downmost-stream imaging engine 22*d* of the intermediate transfer belt 230, and the primarily-transferred image on the intermediate transfer belt 230 is secondarily transferred (collective transfer) onto a recording medium.

In the exemplary embodiment, the secondary transfer device 52 is provided with the secondary transfer roll 521 which is disposed to be brought into pressure-contact with a toner image holding surface of the intermediate transfer belt 230 and the rear roll (which is also the support roll 232 in this example) which is disposed on the rear surface side of the intermediate transfer belt 230 to form an opposite electrode of the secondary transfer roll 521. In addition, for example, the secondary transfer roll 521 is grounded and a bias whose polarity is the same as the charging polarity of the toner is applied to the rear roll (support roll 232). Furthermore, the belt cleaning device 53 is installed on the upstream side of the uppermost-stream imaging engine 22*a* of the intermediate transfer belt 230, and removes a toner remaining on the intermediate transfer belt 230.

In addition, the recording medium supply cassette 24 is provided with the delivery roll 61 which picks a recording medium up. Immediately after the delivery roll 61, the transport roll 62 is installed to deliver the recording medium, and the registration roll (positioning roll) 63 is installed on the recording medium transport path 25 positioned immediately before the secondary transfer site to supply the recording medium to the secondary transfer site at a predetermined time. The recording medium transport path 25 positioned on the downstream side of the secondary transfer site is provided with the fixing device 66, the discharge roll for discharging recording mediums is provided on the downstream side of the fixing device 66, and the paper discharger 68 formed in the upper part of the body housing 21 accommodates discharged recording medium.

Furthermore, in the exemplary embodiment, the manual supply device (MSI) 71 is provided on the side of the body housing 21, and a recording medium on the manual supply device 71 is delivered toward the recording medium transport path 25 by the delivery roll 72 and the transport roll 62.

In addition, the body housing 21 is provided with the two-sided recording unit 73 attached thereto. When two-sided recording mode is selected to perform image recording on two sides of a recording medium, the two-sided recording unit 73 reversely rotates the discharge roll 67 to take a recording medium with one surface on which the recording has ended inward by the guide roll 74 immediately before the inlet port, to thereby transport the recording medium along the internal recording medium returning transport path 76 by the transport roll 77 and supply the recording medium to the positioning roll 63 again.

Cleaning Device

Next, the cleaning device 34 which is disposed in the tandem image forming apparatus shown in FIG. 1 will be described in detail.

Figure 2:
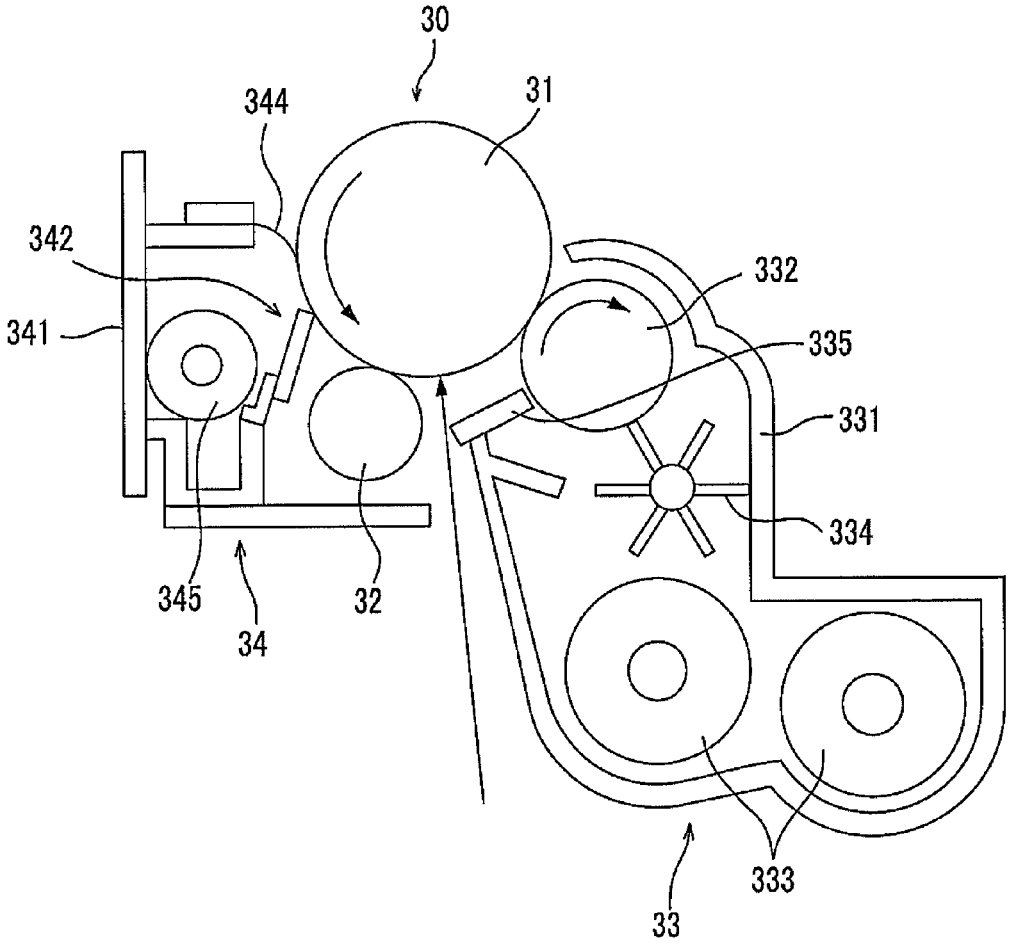
FIG. 2 is a schematic cross-sectional view showing an example of a cleaning device according to the exemplary embodiment.

FIG. 2 is a schematic cross-sectional view showing an example of the cleaning device according to the exemplary embodiment. FIG. 2 shows the photoreceptor drum 31, the charging roll 32, and the developing unit 33, which are formed integrally with each other as a process cartridge, together with the cleaning device 34 shown in FIG. 1.

In FIG. 2, the reference number 32 represents a charging roll (charging device), the reference number 331 represents a unit case, the reference number 332 represents a developing roll, the reference number 333 represents a toner transport member, the reference number 334 represents a transport paddle, the reference number 335 represents a trimming member, the reference number 341 represents a cleaning case, the reference number 342 represents a cleaning blade, the reference number 344 represents a film seal, and the reference number 345 represents a transport member.

The cleaning device 34 has the cleaning case 341 which accommodates a residual toner and has an opening opposed to the photoreceptor drum 31. The cleaning blade 342 which is disposed to be brought into contact with the photoreceptor drum 31 is attached to the lower edge of the opening of the cleaning case 341 with a bracket (not shown) interposed therebetween, and the film seal 344 is attached to the upper edge of the opening of the cleaning case 341 to maintain a space between the photoreceptor drum 31 and the cleaning case 341 in an airtight manner. The reference number 345 represents a transport member which introduces a waste toner accommodated in the cleaning case 341 to a waste toner container on the side.

In the exemplary embodiment, in all of the cleaning devices 34 of the respective imaging engines 22 (22*a* to 22*d*), the cleaning blade according to the exemplary embodiment is used as a cleaning blade. In addition, the cleaning blade 342 is directly fixed to the frame member in the cleaning device 34 in FIG. 2, but not limited thereto. The cleaning blade 342 may be fixed to the frame member with a spring member interposed therebetween.

Next, a configuration of the cleaning blade according to the exemplary embodiment will be described.

The cleaning blade according to the exemplary embodiment is constituted by a member in which a part which is brought into contact with at least the photoreceptor drum (image holding member) 31 has a dynamic micro hardness of from 0.25 to 0.65, and the tuck amount is from 1 μm to 300 μm.

In this description, apart of the cleaning blade, which is brought into contact with a member to be cleaned, will be referred to as "contact member". That is, the cleaning blade according to the exemplary embodiment may be formed only of the contact member.

In addition, when the cleaning blade is constituted so that materials of the contact member and an area other than the contact member are different from each other, a member constituting the area other than the contact member will be referred to as "non-contact member". The non-contact member may be made of one type of material, or constituted by two or more types of members made of different materials.

Figure 3:
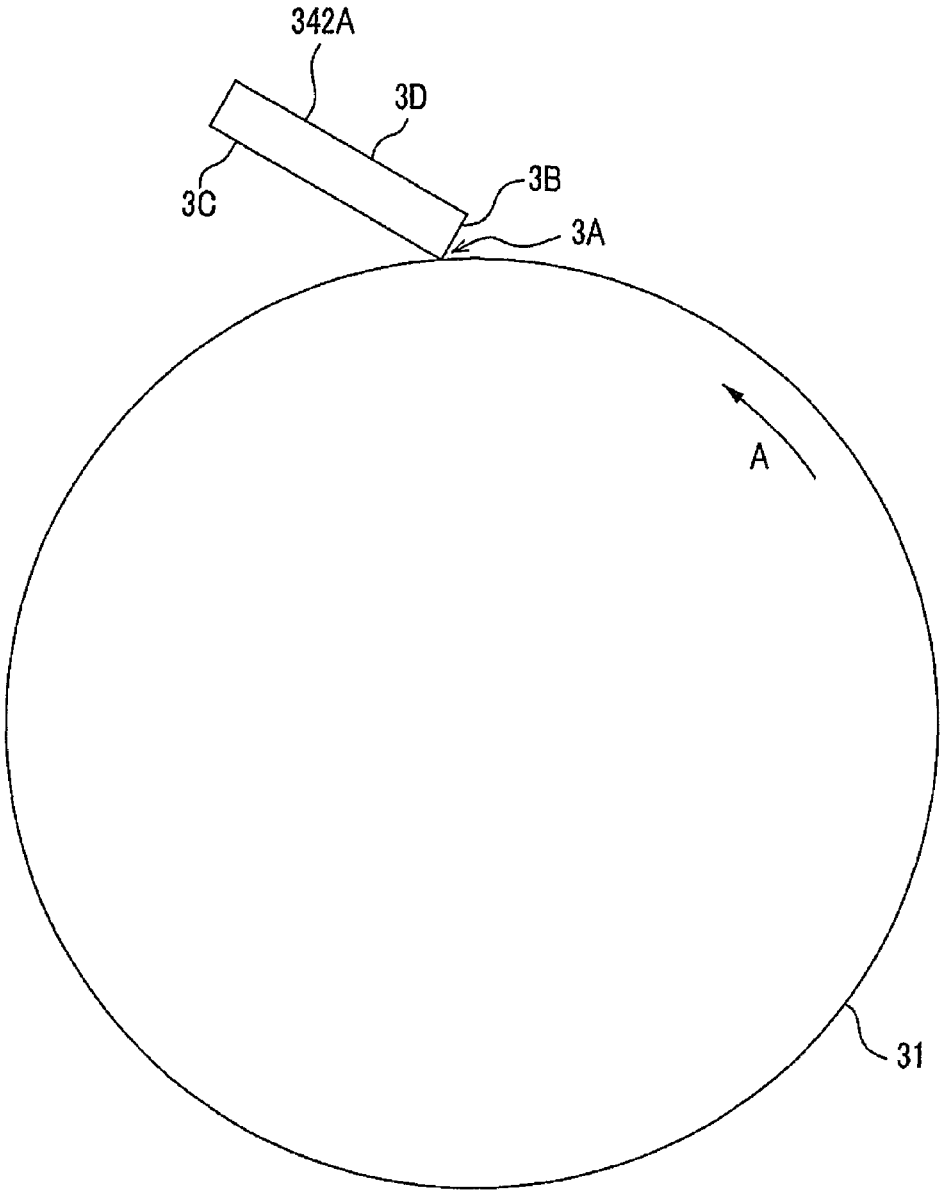
FIG. 3 is a schematic diagram showing an example of a cleaning blade according to the exemplary embodiment.

Here, the configuration of the cleaning blade according to the exemplary embodiment will be described in detail using the drawings. FIG. 3 is a schematic diagram showing a cleaning blade according to a first exemplary embodiment, and shows a state in which the cleaning blade is brought into contact with the surface of the photoreceptor drum. In addition, FIG. 4 is a diagram showing a cleaning blade according to a second exemplary embodiment, and FIG. 5 is a diagram showing a state in which a cleaning blade according to a third exemplary embodiment is brought into contact with the surface of the photoreceptor drum.

Figure 4:
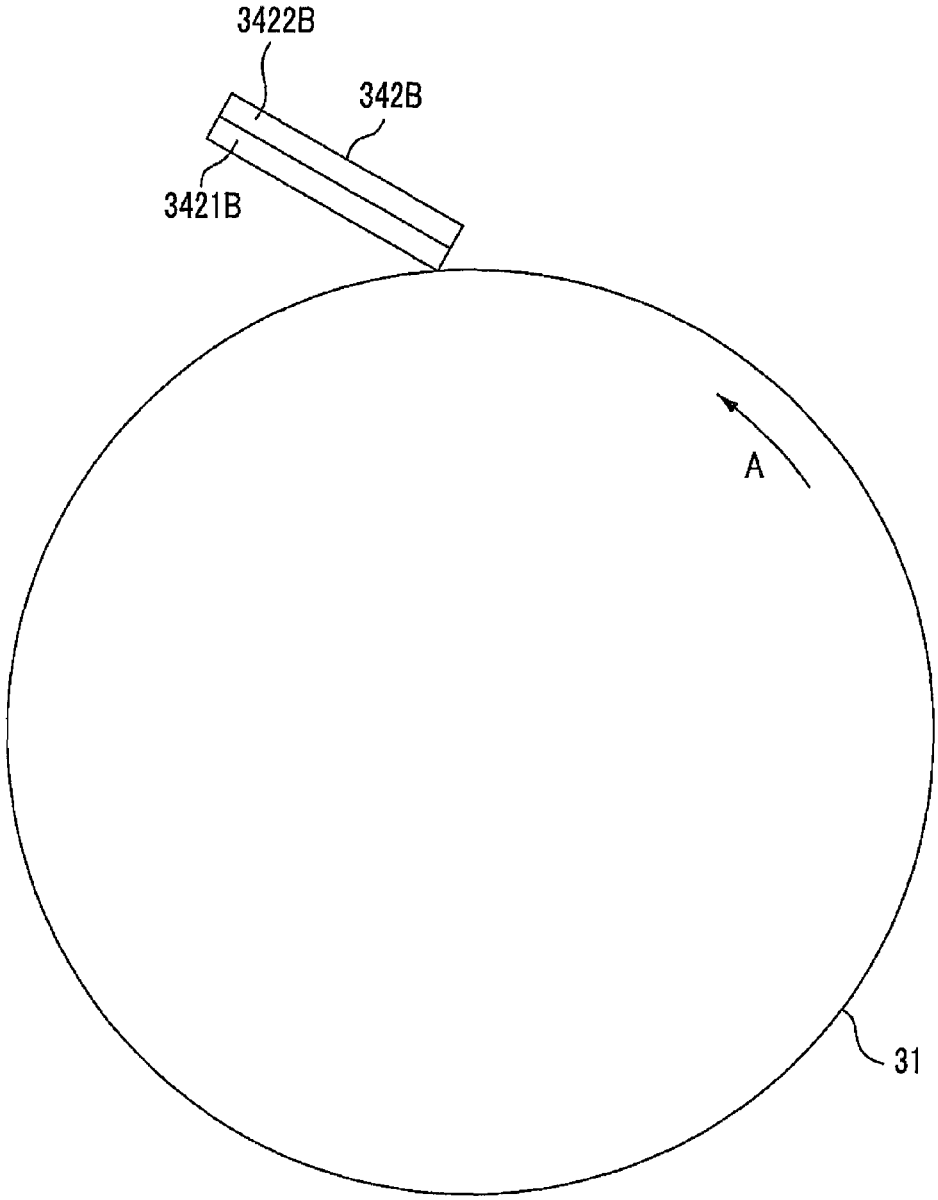
FIG. 4 is a schematic diagram showing another example of the cleaning blade according to the exemplary embodiment.
Figure 5:
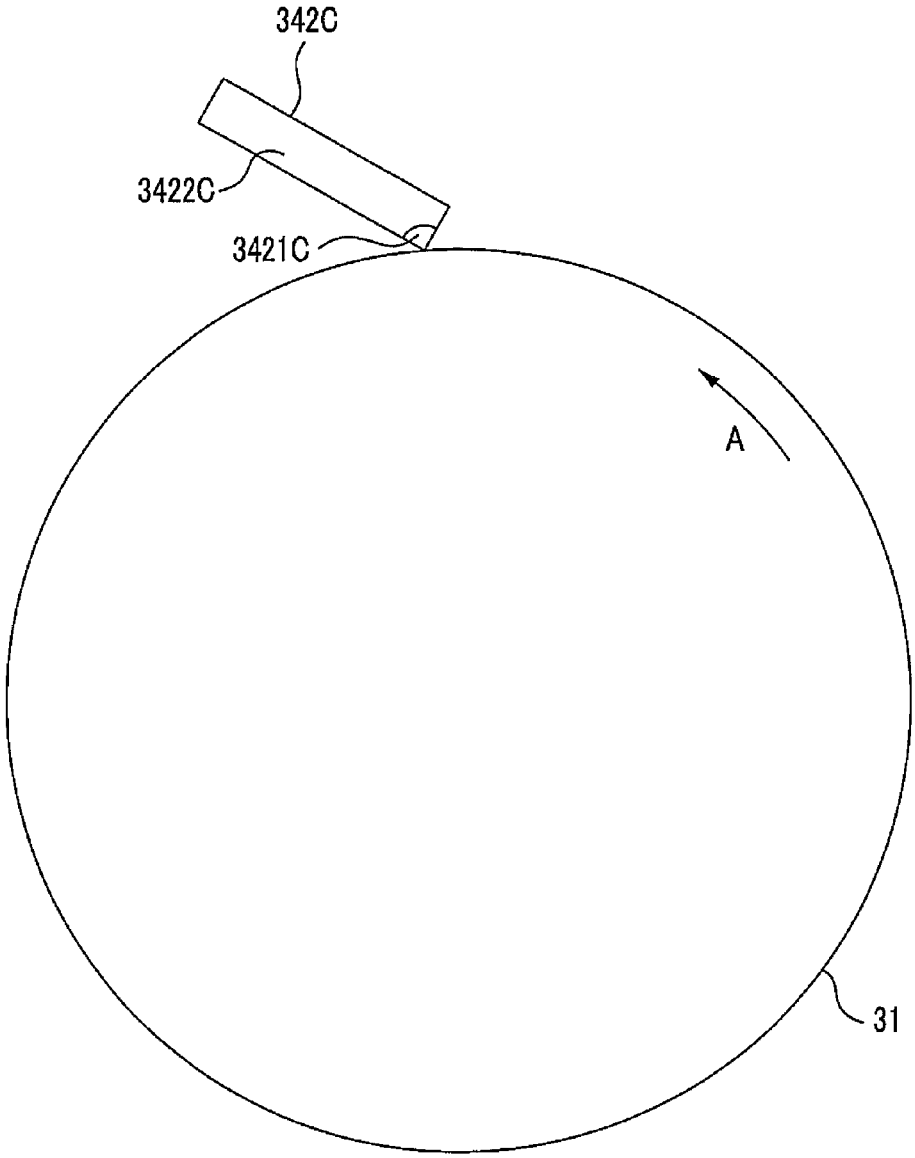
FIG. 5 is a schematic diagram showing a further example of the cleaning blade according to the exemplary embodiment.

Here, in FIGS. 3 to 5, regarding respective parts of the cleaning blade, an angular part which is brought into contact with the photoreceptor drum 31 which is driven in the direction of the arrow A, to clean a surface of the photoreceptor drum 31 will be referred to as a contact angular part 3A, a surface, one side of which is constituted by the contact angular part 3A, which faces the upstream side in the driving direction (direction of the arrow A) will be referred to as a tip end surface 3B, a surface, one side of which is constituted by the contact angular part 3A, which faces the downstream side in the driving direction (direction of the arrow A) will be referred to as a ventral surface 3C, and a surface, one side of which is shared with the tip end surface 3B, which is opposed to the ventral surface 3C will be referred to as a rear surface 3D. In addition, a direction parallel to the contact angular part 3A (that is, a direction from the front toward the inside in FIG. 3) will be referred to as a depth direction, a direction from the contact angular part 3A toward a side on which the tip end surface 3B is formed will be referred to as a thickness direction, and a direction from the contact angular part 3A toward a side on which the ventral surface 3C is formed will be referred to as a width direction.

In addition to a part which is brought into contact with the photoreceptor drum 31, that is, the contact angular part 3A, the entire cleaning blade 342A according to the first exemplary embodiment shown in FIG. 3 is made of a single material, i.e., formed only of a contact member.

The cleaning blade 342B according to the exemplary embodiment may have a two-layer configuration in which a first layer 3421B which is formed over the entire surface of the ventral surface 3C and is formed of a contact member with a part which is brought into contact with the photoreceptor drum 31, that is, the contact angular part 3A included therein, and a second layer 3422B which is formed closer to the rear surface 3D than the first layer and acts as a rear layer made of a material different from that of the contact member are provided, as in the second exemplary embodiment shown in FIG. 4.

Furthermore, the cleaning blade 342C according to the exemplary embodiment may have a configuration provided with a contact member (edge member) 3421C formed of a contact member which has a shape in which a cylinder cut into a quarter extends in the depth direction with a part which is brought into contact with the photoreceptor drum 31, that is, the contact angular part 3A included therein and in which the right-angular part of the shape forms the contact angular part 3A, and a rear member 3422C which covers the rear surface 3D in the thickness direction of the contact member 3421C and the opposite side to the tip end surface 3B in the width direction, that is, constitutes a part other than the contact member 3421C, and is made of a material different from that of the contact member, as in the third exemplary embodiment shown in FIG. 5.

FIG. 5 shows an example of a member having a shape of a cylinder cut into a quarter as a contact member, but the contact member is not limited thereto. The contact member may have a shape such as a shape in which an elliptical cylinder is cut into a quarter, a square prism, or a rectangular prism.

Tuck Amount

In the cleaning blade according to the exemplary embodiment, the maximum length (tuck amount) of the area which is brought into contact with the image holding member in the driving direction of the image holding member is from 1 μm to 300 μm.

Figure 6:
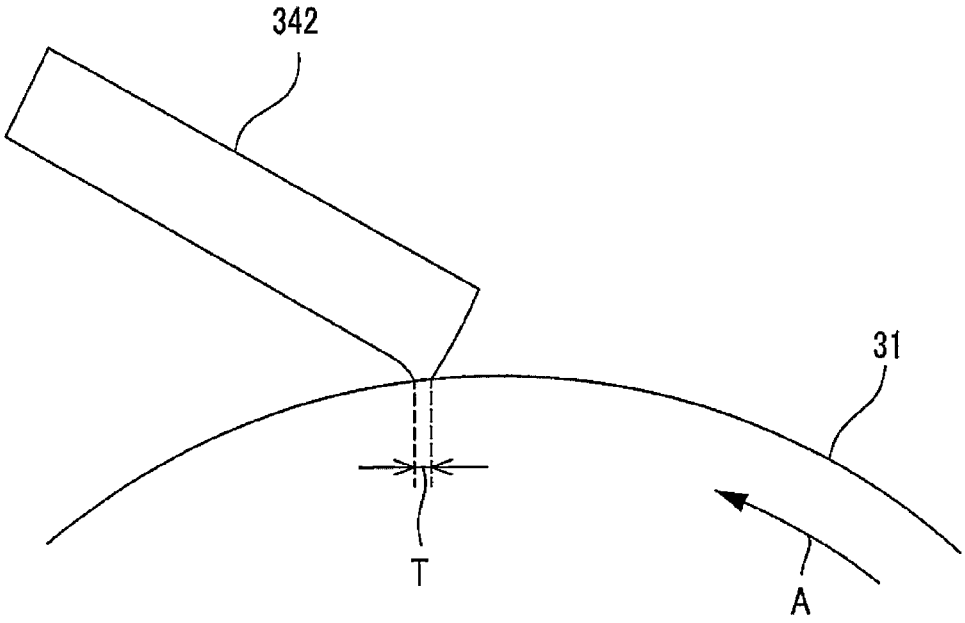
FIG. 6 is a schematic diagram showing a state in which the cleaning blade according to the exemplary embodiment is tucked under an image holding member.

As shown in FIG. 6, "tuck amount" represents a maximum length ("T" in FIG. 6) of the area which is brought into contact with the photoreceptor drum 31 in the driving direction in a state in which kinetic friction occurs in the part in which the cleaning blade 342 and the photoreceptor drum 31 are brought into contact with each other when the photoreceptor drum (image holding member) 31 is driven, and the cleaning blade 342 rolls in the driving direction due to the kinetic friction.

When the tuck amount exceeds the above upper limit value, the size of chips occurring in the cleaning blade is not suppressed and chips having a size exceeding 50 μm may occur. On the other hand, it is disadvantageous that the tuck amount is less than the above lower limit value because a sufficient adhesion property may not be obtained and cleaning errors occur.

The tuck amount is preferably from 1 μm to 100 μm, and more preferably from 1 μm to 50 μm.

The image forming apparatus is driven until a scratch is formed on the surface of the image holding member by the cleaning blade, and the width of the scratch is measured to measure the tuck amount.

The method of controlling the tuck amount is not particularly limited, but examples thereof include the following method.

For example, there is a tendency that the lower the hardness of the part which is brought into contact with the image holding member of the cleaning blade, the greater the tuck amount.

In addition, there is a tendency that the greater the frictional force between the cleaning blade and the image holding member, the greater the tuck amount.

The frictional force is adjusted with the material of a part of the cleaning blade which is brought into contact with the image holding member, the type and amount of a lubricant (lubricant as an external additive which is added to the toner) present on the surface of the image holding member, the pressing force of the cleaning blade against the image holding member, the hardness and roughness of the image holding member, and the like.

In addition, the pressing force is adjusted with a length of the cleaning blade digging deeply into the image holding member, an angle W/A (Working Angle) at the part in which the cleaning blade and the image holding member are brought into contact with each other, the impact resilience of the entire cleaning blade, the Young's modulus, and the like.

Dynamic Micro Hardness

The dynamic micro hardness of the contact member of the cleaning blade is from 0.25 to 0.65. When the dynamic micro hardness is less than the above lower limit value, the hardness of the contact member is insufficient, whereby the size of chips occurring in the cleaning blade is not suppressed and chips having a size exceeding 50 μm may occur. On the other hand, when the dynamic micro hardness exceeds the above upper limit value, the contact member becomes too hard, whereby the cleaning blade does not follow a member to be cleaned which is driven and a favorable cleaning property may not be obtained.

The dynamic micro hardness is preferably from 0.28 to 0.63, and more preferably from 0.3 to 0.6.

In addition, the dynamic micro hardness of the contact member of the cleaning blade is a hardness which is calculated by the following expression from a test load P (mN) and a push-in depth D (μm) when advancing an indenter into a sample at a constant push-in speed (mN/s).

$$DH=\alpha\times P/D^2 \qquad \text{Expression:}$$

In the above expression, α represents a constant according to an indenter shape.

The dynamic micro hardness is measured by a dynamic micro hardness meter DUH-W201S (manufactured by Shimadzu Corporation). The dynamic micro hardness is obtained by measuring a push-in depth D when advancing a diamond triangular pyramid indenter (angle between edges: 115°, α: 3.8584) at a push-in speed of 0.047399 mN/s with a test load of 4.0 mN under the environment of 23° C. through soft material measurement.

Generally, a part of the cleaning blade, which is brought into contact with a member to be cleaned, is an angular part.

Therefore, from the viewpoint of performing the measurement at a position in which the triangular pyramid indenter is pushed, actual measurement positions are deviated from the angular part by 0.5 mm on a surface (ventral surface), one side of which is constituted by the angular part, which faces the downstream side in the driving direction in a state in which the angular part is brought into contact with a member to be cleaned. In addition, the measurement is performed at arbitrary five positions of the above measurement positions to set an average value thereof as a dynamic micro hardness.

The method of controlling the dynamic micro hardness of the contact member is not particularly limited, but examples thereof include the following method.

For example, when the material of the contact member of the cleaning blade is polyurethane, there is a tendency that the dynamic micro hardness increases by increasing the crystalline property of the polyurethane.

In addition, there is a tendency that the dynamic micro hardness increases by increasing a chemical crosslink (increasing a crosslink point).

Furthermore, there is a tendency that the dynamic micro hardness increases by increasing a hard segment amount.

A composition of the contact member constituting a part which is brought into contact with at least a member to be cleaned in the cleaning blade according to the exemplary embodiment will be described.

Contact Member

The contact member of the cleaning blade according to the exemplary embodiment is not particularly limited as long as the above-described dynamic micro hardness is satisfied. Examples of the material of the contact member include polyurethane rubber, silicon rubber, fluororubber, propylene rubber, butadiene rubber, and the like. From the viewpoint of satisfying the requirement for the dynamic micro hardness, polyurethane rubber is preferable, and particularly, highly-crystallized polyurethane rubber is more preferable.

Examples of the method of increasing the crystalline property of polyurethane include a method of growing hard segment aggregates in the polyurethane. Specifically, adjustment is performed so that a physical crosslink (a crosslink by a hydrogen bond between hard segments) more efficiently proceeds than a chemical crosslink (a crosslink by a crosslinking agent) in the formation of a crosslinked structure of the polyurethane, whereby an environment is formed in which the hard segment aggregates are more easily grown. In addition, in the polymerization of polyurethane, the lower the polymerization temperature is set, the aging time increases, and as a result, there is a tendency that the physical crosslink more significantly proceeds.

Endothermic Peak Top Temperature

Examples of the indicator of the crystalline property include an endothermic peak top temperature (melting temperature). In the cleaning blade according to the exemplary embodiment, an endothermic peak top temperature (melting temperature) which is obtained by differential scanning calorimetry (DSC) is preferably 180° C. or higher, more preferably 185° C. or higher, and even more preferably 190° C. or higher. The upper limit value thereof is preferably 220° C. or lower, more preferably 215° C. or lower, and even more preferably 210° C. or lower.

The endothermic peak top temperature (melting temperature) is measured by differential scanning calorimetry (DSC) according to ASTMD 3418-99. Diamond-DSC manufactured by PerkinElmer Co., Ltd. is used in the measurement, melting temperatures of indium and zinc are used in the correction of the temperature of the device detector, and melting heat of indium is used in the correction of the calorific value. A pan made of aluminum is used as a measurement sample and a hollow pan is set for comparison to perform the measurement.

Particle Size and Particle Size Distribution of Hard Segment Aggregates

In addition, in the exemplary embodiment, polyurethane rubber has hard segments and soft segments, and an average particle size of aggregates of the hard segments is preferably from 5 μm to 20 μm.

When the average particle size of the aggregates of the hard segments is 5 μm or greater, the crystal area on the blade surface increases and there is an advantage in that the sliding property is improved. When the average particle size of the aggregates of the hard segments is 20 μm or less, the friction is maintained low and there is an advantage in that toughness (chipping-resistant property) is not lost.

The above average particle size is more preferably from 5 μm to 15 μm, and even more preferably from 5 μm to 10 μm.

In addition, the particle size distribution (standard deviation σ) of the aggregates of the hard segments is preferably 2 or greater.

The fact that the particle size distribution (standard deviation σ) of the aggregates of the hard segments is 2 or greater indicates that particles having various particle sizes are mixed. A high hardness effect which is generated due to an increase in contact area with the soft segments is obtained due to small aggregates, and a sliding property improving effect is obtained due to large aggregates.

The particle size distribution (standard deviation a) is more preferably from 2 to 5, and even more preferably from 2 to 3.

The average particle size and the particle size distribution of the hard segment aggregates are measured by the following method. An image is taken at 20-fold magnification using a polarization microscope (BX51-P manufactured by Olympus Corporation) and subjected to an image process to binarize the image, and particle sizes are measured at five points per one cleaning blade (five aggregates are measured per one point) and the measurement is performed on twenty cleaning blades. The average particle size is calculated from total 500 aggregates.

Regarding the image binarization, thresholds of a hue, a saturation, and an intensity are adjusted using image process software OLYMPUS Stream essentials (manufactured by Olympus Corporation) so that crystal parts become black and amorphous parts become white.

In addition, the particle size distribution (standard deviation σ) is calculated by the following expression from the measured 500 particle sizes.

$$\text{Standard Deviation } \sigma=\sqrt{\{(X1-M)^2+(X2-M)^2+\ldots+(X500-M)^2\}/500}$$

Xn: Measured Particle Size n (n=from 1 to 500)

M: Average Value of Measured Particle Sizes

The method of controlling the particle size and the particle size distribution (standard deviation a) of the hard segment aggregates in the above range is not particularly limited, but examples thereof include reaction control by a catalyst, three-dimensional network control by a crosslinking agent, crystal growth control by aging conditions, and the like.

Generally, polyurethane rubber is synthesized by polymerizing polyisocyanate and polyol. In addition, a resin having a functional group which may react with an isocyanate group other than polyol may be used. Polyurethane rubber preferably has hard segments and soft segments.

Here, "hard segments" and "soft segments" mean segments in which in a polyurethane rubber material, a material constituting the former is relatively harder than a material constituting the latter, and the material constituting the latter is relatively softer than the material constituting the former.

The combination of the material (hard segment material) constituting the hard segments and the material (soft segment material) constituting the soft segments is not particularly limited, and the materials may be selected from known resin materials so that one material is relatively harder than the other material, and the other material is relatively softer than the one material. However, in the exemplary embodiment, the following combination is preferable.

Soft Segment Material

First, examples of polyols as the soft segment material include polyester polyols which are obtained by dehydration condensation of diols and dibasic acids, polycarbonate polyols which are obtained by the reaction of diols and alkyl carbonates, polycaprolactone polyols, polyether polyols, and the like. Examples of commercialized products of the polyols which are used as the soft segment material include PLACCEL 205, PLACCEL 240, and the like manufactured by Daicel Corporation.

Hard Segment Material

In addition, as the hard segment material, a resin having a functional group which may react with an isocyanate group is preferably used. In addition, the hard segment material is preferably a flexible resin, and more preferably an aliphatic resin having a straight chain structure from the viewpoint of flexibility. As a specific example thereof, an acrylic resin including two or more hydroxyl groups, a polybutadiene resin including two or more hydroxyl groups, an epoxy resin having two or more epoxy groups, or the like is preferably used.

Examples of commercialized products of the acrylic resin including two or more hydroxyl groups include Actflow (grade: UMB-20058, UMB-2005P, UMB-2005, UME-2005, and the like) manufactured by Soken Chemical Engineering Co., Ltd.

Examples of commercialized products of the polybutadiene resin including two or more hydroxyl groups include R-45HT manufactured by Idemitsu Kosan Co., Ltd., and the like.

The epoxy resin having two or more epoxy groups is preferably not hard and fragile as in the cases of general epoxy resins in the related art, but more flexible and tougher than epoxy resins in the related art. For example, as for the molecular structure, the epoxy resin preferably has a structure (flexible skeleton) in which in a main chain structure thereof, mobility of a main chain may be increased. Examples of the flexible skeleton include an alkylene skeleton, a cycloalkane skeleton, a polyoxyalkylene skeleton, and the like, and particularly, a polyoxyalkylene skeleton is preferable.

In addition, as for the physical property, the epoxy resin having a low viscosity in proportion to the molecular weight is more preferable than epoxy resins in the related art. Specifically, the weight average molecular weight is in the range of 900±100, and the viscosity at 25° C. is preferably in the range of 15000±5000 mPa·s, and more preferably in the range of 15000±3000 mPa·s. Examples of commercialized products of the epoxy resin having this characteristic include EPLICON EXA-4850-150 manufactured by DIC, and the like.

When the hard segment material and the soft segment material are used, the weight ratio (hereinafter, referred to as "hard segment material ratio") of the material constituting the hard segments with respect to the total amount of the hard segment material and the soft segment material is preferably from 10 wt % to 30 wt %, more preferably from 13 wt % to 23 wt %, and even more preferably from 15 wt % to 20 wt %.

When the hard segment material ratio is 10 wt % or greater, an abrasion-resistant property is obtained and a favorable cleaning property is maintained over a long period of time. When the hard segment material ratio is 30 wt % or less, the material does not become too hard, thus flexibility and extensibility are obtained, and occurrence of chips is suppressed. Thus, a favorable cleaning property is maintained over a long period of time.

Polyisocyanate

Examples of polyisocyanate which is used in synthesis of polyurethane rubber include 4,4'-diphenylmethane diisocyanate (MDI), 2,6-toluene diisocyanate (TDI), 1,6-hexane diisocyanate (HDI), 1,5-naphthalene diisocyanate (NDI), 3,3-dimethylphenyl-4,4-diisocyanate (TODI), and the like.

From the viewpoint of ease of the formation of hard segment aggregates having a desired size (particle size), 4,4'-diphenylmethane diisocyanate (MDI), 1,5-naphthalene diisocyanate (NDI), hexanemethylene diisocyanate (HDI) are preferable as polyisocyanate.

The blending amount of polyisocyanate with respect to 100 parts by weight of a resin having a functional group which may react with an isocyanate group is preferably from 20 parts by weight to 40 parts by weight, more preferably from 20 parts by weight to 35 parts by weight, and even more preferably from 20 parts by weight to 30 parts by weight.

When the blending amount is 20 parts by weight or greater, a large urethane bonding amount is secured, and thus hard segments grow and a desired hardness is obtained. When the blending amount is 40 parts by weight or less, the size of hard segments does not excessively increase, extensibility is obtained, and occurrence of chips in the cleaning blade is suppressed.

Crosslinking Agent

Examples of the crosslinking agent include dios (bifunctional), triols (trifunctional), tetraols (tetrafunctional), and the like. In addition, amine-based compounds may be used as the crosslinking agent. In addition, a tri- or more-functional crosslinking agent is preferably used for crosslinking. Examples of trifunctional crosslinking agents include trimethylolpropane, glycerin, triisopropanolamine, and the like.

The blending amount of the crosslinking agent with respect to 100 parts by weight of a resin having a functional group which may react with an isocyanate group is preferably 2 parts by weight or less. When the blending amount is 2 parts by weight or less, hard segments derived from the urethane bond by aging grow very much without molecular movement restrained by a chemical crosslink and a desired hardness is easily obtained.

Method of Manufacturing Polyurethane Rubber

For manufacturing a polyurethane rubber member constituting the contact member according to the exemplary embodiment, a general polyurethane manufacturing method such as a prepolymer method or a one-shot method is used. In the exemplary embodiment, the prepolymer method is preferable because polyurethane having an excellent strength and an excellent abrasion-resistant property is obtained. However, the invention is not limited to the manufacturing method.

As the method of controlling the endothermic peak top temperature (melting temperature) in the contact member in the above range, a method of increasing and controlling the crystalline property of the polyurethane member in an appropriate range is exemplified, and examples thereof include a method of growing hard segment aggregates in polyurethane. Specific examples thereof include a method of performing adjustment polyurethane so that a physical crosslink (a crosslink by a hydrogen bond between hard segments) more efficiently proceeds than a chemical crosslink (a crosslink by a crosslinking agent) in the formation of a crosslinked structure of polyurethane. In the polymerization of polyurethane, the lower the polymerization temperature is set, the aging time increases, and as a result, there is a tendency that the physical crosslink more significantly proceeds.

An isocyanate compound, a crosslinking agent, and the like are blended with the above-described polyol to mold the polyurethane rubber member under molding conditions in which unevenness in molecular arrangement may be suppressed.

Specifically, when adjusting a polyurethane composition, the temperature of polyol or prepolymer or the temperature of hardening/molding is reduced to perform the adjustment so that the crosslinking slowly proceeds. When these temperatures (temperature of polyol or prepolymer and temperature of hardening/molding) are set to be low and the reactivity is thus lowered, the urethane bonding part aggregates and crystals of hard segments are obtained. Thus, the temperature is adjusted so that the particle size of the hard segment aggregates becomes a desired crystal size.

Accordingly, molecules included in the polyurethane composition are arranged, and thus a polyurethane rubber member including crystals in which the endothermic peak top temperature of crystal melting energy is in the above range in the DSC is molded.

The amounts of the polyol, polyisocyanate, and crosslinking agent, the ratio of the crosslinking agent, and the like are adjusted in desired ranges, respectively.

As for the molding of the cleaning blade, a cleaning blade forming composition prepared by the above method is formed into a sheet shape using, for example, centrifugal molding, extrusion molding, or the like, and cutting or the like is performed to produce the cleaning blade.

Here, the method of manufacturing the contact member will be described in detail with an example.

First, a soft segment material (for example, polycaprolactone polyol) and a hard segment material (for example, an acrylic resin including two or more hydroxyl groups) are mixed (for example, at a weight ratio of 8:2).

Next, to the resultant mixture of the soft segment material and the hard segment material, an isocyanate compound (for example, 4,4'-diphenylmethane diisocyanate) is added to react with the mixture under, for example, a nitrogen atmosphere. At this time, the temperature is preferably from 60° C. to 150° C., and more preferably from 80° C. to 130° C. In addition, the reaction time is preferably from 0.1 hours to 3 hours, and more preferably from 1 hour to 2 hours.

Next, an isocyanate compound is further added to react with the mixture under, for example, a nitrogen atmosphere to thereby obtain a prepolymer. At this time, the temperature is preferably from 40° C. to 100° C., and more preferably from 60° C. to 90° C. In addition, the reaction time is preferably from 30 minutes to 6 hours, and more preferably from 1 hour to 4 hours.

Next, the prepolymer is heated and defoamed under a reduced pressure. At this time, the temperature is preferably from 60° C. to 120° C., and more preferably from 80° C. to 100° C. The reaction time is preferably from 10 minutes to 2 hours, and more preferably from 30 minutes to 1 hour.

Thereafter, a crosslinking agent (for example, 1,4-butanediol or trimethylolpropane) is added to the prepolymer to be mixed therewith, and a cleaning blade forming composition is prepared.

Next, the cleaning blade forming composition is allowed to flow to a mold of a centrifugal molding machine, and subjected to a hardening reaction. At this time, the temperature of the mold is preferably from 80° C. to 160° C., and more preferably from 100° C. to 140° C. In addition, the reaction time is preferably from 20 minutes to 3 hours, and more preferably from 30 minutes to 2 hours.

The hardened composition is subjected to a crosslinking reaction, cooled, and then cut, whereby a cleaning blade is formed. In this crosslinking reaction, the temperature of aging heating is preferably from 70° C. to 130° C., more preferably from 80° C. to 130° C., and even more preferably from 100° C. to 1.20° C. In addition, the reaction time is preferably from 1 hour to 48 hours, and more preferably from 10 hours to 24 hours.

Physical Property

In the above specific member, the ratio of a physical crosslink (a crosslink by a hydrogen bond between hard segments) to a chemical crosslink (a crosslink by a crosslinking agent) "1" in the polyurethane rubber is preferably from 1:0.8 to 1:2.0, and more preferably from 1:1 to 1:1.8.

When the ratio of the physical crosslink to the chemical crosslink is equal to or greater than the above lower limit value, hard segment aggregates further grow and a low frictional property effect derived from the crystals is obtained. When the ratio is equal to or less than the above upper limit value, a toughness maintaining effect is obtained.

The ratio of the physical crosslink to the chemical crosslink is calculated using the following Moobey-Rivilin expression.

$$\sigma=2C_1(\lambda-1/\lambda^2)+2C_2(1-1/\lambda^3)$$

$\sigma$: Stress, $\lambda$: Distortion, $C_1$: Chemical Crosslink Density, $C_2$: Physical Crosslink $\sigma$ and $\lambda$ at the time of 10%-extension are used from a stress-distortion curve which is obtained by a tensile test.

In the above specific member, the ratio of hard segments to soft segments "1" in the polyurethane rubber is preferably from 1:0.15 to 1:0.3, and more preferably from 1:0.2 to 1:0.25.

When the ratio of the hard segments to the soft segments is equal to or greater than the above lower limit value, the amount of hard segment aggregates increases, and thus a low frictional property effect is obtained. When the ratio is equal to or less than the above upper limit value, a toughness maintaining effect is obtained.

Regarding the ratio of the hard segments to the soft segments, a composition ratio is calculated using $^1$H-NMR from spectrum areas of isocyanate and a chain extender as hard segment components and polyol as a soft segment component.

The weight average molecular weight of the polyurethane rubber member according to the exemplary embodiment is preferably from 1000 to 4000, and more preferably from 1500 to 3500.

Next, a composition of the non-contact member when the cleaning blade according to the exemplary embodiment is constituted so that materials of the contact member and an area (non-contact member) other than the contact member are different from each other as in the second exemplary embodiment shown in FIG. 4 and the third exemplary embodiment shown in FIG. 5 will be described.

Non-Contact Member

The material of the non-contact member of the cleaning blade according to the exemplary embodiment is not particularly limited and any known material may be used.

Impact Resilience

The non-contact member is preferably made of a material having an impact resilience at 50° C. of 70% or less, more preferably 65% or less, and even more preferably 60% or less.

In addition, the lower limit value thereof is preferably 20% or greater, and more preferably 25% or greater.

The impact resilience (%) at 50° C. is measured under the environment of 50° C. according to JIS K6255 (1996). When the non-contact member of the cleaning blade has a size equal to or greater than a dimension of a test piece specified in JIS K6255, the member is cut to have the dimension of the test piece to thereby perform the measurement. When the non-contact member has a size less than the dimension of the test piece, a test piece is formed using a material which is the same as that of the member and is subjected to the measurement.

The method of controlling the impact resilience at 50° C. of the non-contact member is not particularly limited. However, for example, when the contact member is polyurethane, there is a tendency that the impact resilience at 50° C. increases by adjusting a glass transition temperature (Tg) by reducing the molecular weight of polyol or hydrophobizing the polyol.

Permanent Elongation

In addition, the non-contact member of the cleaning blade according to the exemplary embodiment is made of a material, the 100%-permanent elongation of which is preferably 1.0% or less, more preferably 0.9% or less, and even more preferably 0.8% or less.

Here, the method of measuring the 100%-permanent elongation (%) will be described.

According to JIS K6262 (1997), a strip test piece is used and 100%-tensile distortion is applied thereto. The strip test piece is left for 24 hours and the 100%-permanent elongation is obtained from the distance between marked lines through the following expression.

$$Ts=(L2-L0)/(L1-L0)\times 100$$

Ts: Permanent Elongation

L0: Distance Between Marked Lines Before Tension

L1: Distance Between Marked Lines At the Time of Tension

L2: Distance Between Marked Lines After Tension

When the non-contact member of the cleaning blade has a size equal to or greater than a dimension of a strip test piece specified in JIS K6262, the member is cut to have the dimension of the strip test piece to thereby perform the measurement. When the non-contact member has a size less than the dimension of the strip test piece, a strip test piece is formed using a material which is the same as that of the member and is subjected to the measurement.

The method of controlling the 100%-permanent elongation of the non-contact member is not particularly limited. However, there is a tendency that the 100%-permanent elongation varies by adjusting the amount of the crosslinking agent, or by adjusting the molecular weight of polyol when the contact member is polyurethane.

Examples of the material which is used for the non-contact member include polyurethane rubber, silicon rubber, fluororubber, propylene rubber, butadiene rubber, and the like. Among them, polyurethane rubber is preferable. Examples of the polyurethane rubber include ester-based polyurethane and ether-based polyurethane, and ester-based polyurethane is particularly preferable.

A method using polyol and polyisocyanate is employed in manufacturing polyurethane rubber.

Examples of polyol include polytetramethyl ether glycol, polyethylene adipate, polycaprolactone, and the like.

Examples of polyisocyanate include 2,6-toluene diisocyanate (TDI), 4,4'-diphenyl methane diisocyanate (MDI), paraphenylene diisocyanate (PPDI), 1,5-naphthalene diisocyanate (NDI), 3,3-dimethyl diphenyl-4,4'-diisocyanate (TODI), and the like. Among them, MDI is preferable.

Furthermore, examples of a hardening agent which hardens polyurethane include 1,4-butanediol, trimethylolpropane, ethylene glycol, and mixtures thereof.

When describing a specific example thereof, for example, in a prepolymer generated by mixing and reacting diphenylmethane-4,4-diisocyanate with dehydrated polytetramethyl ether glycol, a material in which 1,4-butanediol and trimethylolpropane are used in combination with each other is preferably used as a hardening agent. Additives such as a reaction adjuster may be added.

As the method of producing the non-contact member, known methods in the related art are used in accordance with a raw material which is used in the production. For example, a material is formed using, for example, centrifugal molding, extrusion molding, or the like and cut into a predetermined shape to produce the non-contact member.

Manufacturing of Cleaning Blade

When the cleaning blade has a multilayer configuration such as the two-layer configuration shown in FIG. 4, the cleaning blade is produced by pasting the first layer as a contact member and the second layer (in the case of a layer configuration of three or more layers, plural layers) as a non-contact member together. As the pasting method, double-stick tape, various adhesives, and the like are preferably used. In addition, the plural layers may be adhered to each other by allowing the materials of the respective layers to flow to a mold at intervals at the time of molding and by bonding the materials to each other without providing an adhesion layer.

In addition, in the case of the configuration having the contact member (edge member) and the non-contact member (rear member) shown in FIG. 5, a mold having a cavity corresponding to a semicircular column shape in which two contact members 3421C shown in FIG. 5 are combined is provided. A contact member forming composition is allowed to flow to the mold, and hardened to form a first molded product. Next, the mold is removed, and then a non-contact member forming composition is allowed to flow around the first molded product, and hardened to form a second molded product. Thereafter, cutting is performed at the center of the second molded product to divide the semicircular column-shaped contact member at the center, whereby a cylinder shape cut into a quarter is formed. Further cutting into a predetermined dimension is performed, and thus the cleaning blade shown in FIG. 5 is obtained.

The thickness of the entire cleaning blade is preferably from 1.5 mm to 2.5 mm, and more preferably from 1.8 mm to 2.2 mm.

Setting of Cleaning Blade

Next, the setting of the cleaning blade of the cleaning device according to the exemplary embodiment will be described.

The pressing force NF (Normal Force) of the cleaning blade according to the exemplary embodiment against the image holding member is preferably from 1.3 gf/mm to 2.3 gf/mm, and more preferably from 1.6 gf/mm to 2.0 gf/mm.

Using a device which measures the relationship between a digging amount of the blade and a load, the pressing force NF is obtained by dividing a load at the time when a set digging amount is reached by the entire blade length.

In addition, the length of the tip end part of the cleaning blade digging deep into the image holding member is preferably from 0.8 mm to 1.2 mm, and more preferably from 0.9 mm to 1.1 mm.

An angle W/A (Working Angle) at the part in which the cleaning blade and the image holding member are brought into contact with each other is preferably from 8° to 14°, and more preferably from 10° to 12°.

Developing Device

The developing unit (developing device) 33 which is used in the exemplary embodiment has, for example, the unit case 331 which accommodates a developer and has an opening opposed to the photoreceptor drum 31 as shown in FIG. 2. Here, the developing roll 332 is installed at a position facing the opening of the unit case 331, and in the unit case 331, the toner transport member 333 is installed for stirring and transporting a developer. Furthermore, the transport paddle 334 may be installed between the developing roll 332 and the toner transport member 333.

In the developing, a developer is supplied to the developing roll 332, and then for example, in a state in which the thickness of the developer layer is regulated by the trimming member 335, the developer is transported to a developing area opposed to the photoreceptor drum 31.

In the exemplary embodiment, for example, a two-component developer formed of a toner and a carrier, or a single-component developer formed only of a toner may be used in the developing unit 33.

Toner

Hereinafter, a toner which is accommodated in the developing device in the exemplary embodiment will be described.

The toner according to the exemplary embodiment includes toner particles and an external additive. The external additive has an average particle size of 0.02 μm or greater, and at least one type selected from metallic soap particles and inorganic particles having an oil-treated surface is used.

External Additive

As the external additive, an external additive having an average particle size of 0.02 μm or greater is used. The average particle size is preferably from 0.05 μm or greater, and more preferably 0.1 μm or greater. In addition, the upper limit value thereof may be less than the size of chips which are thought to be formed in the cleaning blade according to the exemplary embodiment. Specifically, the upper limit value is preferably less than 10 μm, more preferably 9 μm or less, and even more preferably 8 μm or less.

The average particle size (volume average particle size) of the external additive is measured using a laser diffraction-type particle size distribution measuring device (LA-700: manufactured by Horiba, Ltd.). As for the measurement method, a sample in a state of a dispersion liquid is adjusted to have a solid content of 2 g and ion exchange water is added thereto to make 40 ml. The resultant material is charged in a cell at up to an appropriate concentration and the measurement is performed thereon after waiting for 2 minutes. The obtained volume average particle size for each channel is accumulated from the smallest side, and a value corresponding to an accumulation of 50% is set as a volume average particle size.

When many primary particles of the external additive aggregate and secondary particles are formed, shear is applied to the secondary particles to make a state in which the primary particles break into pieces, and then the measurement is performed.

First, inorganic particles having an oil-treated surface (hereinafter, also simply referred to as "oil-treated inorganic particles") will be described.

Examples of the inorganic particles include silicon oxide (silica), aluminum oxide, zinc oxide, titanium oxide, tin oxide, iron oxide, magnesium oxide, calcium carbonate, calcium oxide, and barium titanate. Among them, silicon oxide (silica), aluminum oxide, zinc oxide, titanium oxide, and tin oxide are preferable.

As the method of manufacturing inorganic particles, known methods are applied, and examples thereof include a combustion method.

As an oil which is used in the surface treatment of inorganic particles, for example, a silicone oil is preferable.

Specific examples of the silicone oil include a methyl phenyl silicone oil, a dimethyl silicone oil, an alkyl-modified silicone oil, an amino-modified silicon oil, an alkoxy-modified silicone oil, and the like. Among them, a dimethyl silicone oil and an amino-modified silicon oil are preferable.

Oil-treated inorganic particles are obtained by treating the inorganic particles with the oil. The oil amount which is used in the treatment (oil treatment amount) is preferably from 1 part by weight to 10 parts by weight, more preferably from 1 part by weight to 9 parts by weight, and even more preferably from 1 part by weight to 8 parts by weight with respect to 100 parts by weight of inorganic particles.

The surface treatment with an oil is performed using a known method. For example, the surface treatment is performed using a dry method by a spray dry method or the like of spraying an oil or a solution containing an oil to particles floating in the gas phase, a wet method of dipping particles in a solution containing an oil and drying the solution, a mixing method of mixing a treatment agent and particles using a mixer, or the like.

In addition, after the surface treatment, cleaning may be performed with a solvent to remove a residual oil, low-boiling point residues, or the like.

When the oil-treated inorganic particles are used as an external additive, the average particle size thereof is preferably from 0.02 μm to 0.3 μm, and more preferably from 0.02 μm to 0.2 μm.

Next, metallic soap particles will be described.

Examples of the metallic soap particles include fatty acids such as zinc stearate, barium stearate, lead stearate, iron stearate, nickel stearate, cobalt stearate, copper stearate, strontium stearate, calcium stearate, cadmium stearate, magnesium stearate, zinc oleate, manganese oleate, iron oleate, cobalt oleate, lead oleate, magnesium oleate, copper oleate, zinc palmitate, cobalt palmitate, copper palmitate, magnesium palmitate, aluminum palmitate, calcium palmitate, lead caprylate, lead caproate, zinc linolenate, cobalt linolenate, calcium linolenate, and cadmium linolenate.

Among them, zinc stearate is preferable.

In addition, the metallic soap particles may be subjected to the above-described oil treatment which is performed on the inorganic particles.

When the metallic soap particles are used as an external additive, the average particle size is preferably from 1 μm to 10 μm, and more preferably from 2 μm to 8 μm.

The amount of the external additive added to the toner particles, which is selected from the metallic soap particles and the oil-treated inorganic particles is preferably from 0.05 parts by weight to 3 parts by weight, and more preferably from 0.1 parts by weight to 2 parts by weight with respect to 100 parts by weight of toner particles.

Toner Particles

Next, constituent components of the toner particles will be described in detail.

As a binder resin which is used in the toner particles, a known material is used, and examples thereof include crystalline resins and amorphous resins.

Examples of the binder resin include homopolymers and copolymers, e.g., styrenes such as styrene and chlorostyrene; monoolefins such as ethylene, propylene, butylene, and isoprene; vinyl esters such as vinyl acetate, vinyl propionate, vinyl benzoate, and vinyl butyrate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodedyl methacrylate; vinyl ethers such as vinyl methyl ether, vinyl ethyl ether, and vinyl butyl ether; and vinyl ketones such as vinyl methyl ketone, vinyl hexyl ketone, and vinyl isopropenyl ketone.

Representative examples of the binder resin include polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene, polypropylene, and the like. In addition, polyester, polyurethane, an epoxy resin, a silicone resin, polyamide, modified rosin, paraffin wax, and the like are also included.

Among them, particularly, styrene-alkyl acrylate copolymers and styrene-alkyl methacrylate copolymers are preferable.

In addition, specific examples of the crystalline resin include polyester resins using dicarboxylic acids of long-chain alkyl such as an adipic acid, a pimelic acid, a suberic acid, an azelaic acid, a sebacic acid, a dodecanedioic acid, and a tridecanedioic acid, and diols of long-chain alkyl and alkenyl such as butanediol, pentanediol, hexanediol, heptanediol, octanediol, nonanediol, decanediol, and batyl alcohol; vinyl-based resins using (meth)acrylic ester of long-chain alkyl and alkenyl such as (meth)acrylic amyl, (meth) acrylic hexyl, (meth)acrylic heptyl, (meth)acrylic octyl, (meth)acrylic nonyl, (meth)acrylic decyl, (meth)acrylic undecyl, (meth)acrylic tridecyl, (meth)acrylic myristyl, (meth)acrylic cetyl, (meth)acrylic stearyl, (meth)acrylic oleil, and (meth)acrylic behenyl; and the like, and polyester resin-based crystalline resins are preferable.

A colorant may be contained in the toner particles. The colorant is not particularly limited and may be any of a dye and a pigment, but the pigment is preferable.

Preferable examples of the pigment include known pigments such as carbon black, aniline black, aniline blue, calcoil blue, chrome yellow, ultramarine blue, dupont oil red, quinoline yellow, methylene blue chloride, phthalocyanine blue, malachite green oxalate, lamp black, rose bengal, quinacridone, benzidine yellow, C.I. pigment red 48:1, C.I. pigment red 57:1, C.I. pigment red 122, C.I. pigment red 185, C.I. pigment yellow 12, C.I. pigment yellow 17, C.I. pigment yellow 180, C.I. pigment yellow 97, C.I. pigment yellow 74, C.I. pigment blue 15:1, and C.I. pigment blue 15:3.

In addition, a magnetic powder may be used as a colorant. Examples of the magnetic powder include known magnetic materials such as ferromagnetic metals such as cobalt, iron, and nickel, alloys or oxides of metals such as cobalt, iron, nickel, aluminum, lead, magnesium, zinc, and manganese, and the like.

The above colorants may be used alone or in combination of two or more types. When the type of the colorant is selected, color toners such as a yellow toner, a magenta toner, a cyan toner, and a black toner are obtained.

The content of the colorant included in the toner is preferably from 0.1 parts by weight to 40 parts by weight, and more preferably from 1 part by weight to 30 parts by weight with respect to 100 parts by weight of toner particles.

Other components such as a release agent and a charging control agent may be internally added to the toner according to the exemplary embodiment.

Generally, the release agent is used to improve a release property. Specific examples of the release agent include low-molecular-weight polyolefins such as polyethylene, polypropylene, and polybutene; silicones which soften by heating; fatty amides such as oleic amide, erucic amide, ricinoleic amide, and stearic amide; vegetable waxes such as carnauba wax, rice wax, candelilla wax, Japan wax, and jojoba oil; animal waxes such as bees wax; mineral or petroleum waxes such as montan wax, ozokerite, ceresin, paraffin wax, microcrystalline wax, and Fischer-Tropsch wax; and ester-based waxes such as fatty acid ester, montanate ester, and carboxylate ester. The release agents may be used alone or in combination of two or more types.

The content of the release agent is preferably from 1 part by weight to 20 parts by weight, and more preferably from 2 parts by weight to 15 parts by weight with respect to 100 parts by weight of toner particles.

The melting temperature of the release agent is preferably from 50° C. to 120° C., and more preferably from 60° C. to 100° C.

As the charging control agent, a known charging control agent is used, and examples thereof include azo-based metal complex compounds, metal complex compounds of salicylic acid, resin-type charging control agents containing a polar group, and the like.

When the toner is manufactured by a wet manufacturing method, a material which is not easily dissolved in water is preferably used.

In the manufacturing of toner particles, known wet methods or dry methods are used, and among them, wet methods are preferable for manufacturing.

Examples of the method of manufacturing toner particles by a wet method include methods of generating toner particles in an acidic or alkaline aqueous medium, such as an aggregation coalescence method, a suspension polymerization method, a dissolution suspension granulation method, a dissolution suspension method, and a dissolution emulsion aggregation coalescence method, and particularly, an aggregation coalescence method is preferable.

Here, an example of the method of manufacturing toner particles by an aggregation coalescence method will be described.

Specifically, a manufacturing method including a first aggregation process in which a resin particle dispersion liquid having first resin particles dispersed therein, a colorant particle dispersion liquid having colorant particles dispersed therein, and a release agent particle dispersion liquid having release agent particles dispersed therein are mixed to form core-aggregated particles including the first resin particles, the colorant particles, and the release agent particles, a second aggregation process in which a shell layer including second resin particles is formed on surfaces of the core-aggregated particles to obtain core/shell-aggregated particles, and a fusion coalescence process in which the core/shell-aggregated particles are heated to a temperature equal to or higher than the glass transition temperature of the first resin particles or the second resin particles, and fuse and coalesce.

(1) Aggregation Process

In the first aggregation process, first, a resin particle dispersion liquid, a colorant particle dispersion liquid, and a release agent particle dispersion liquid are prepared.

The resin particle dispersion liquid is prepared by, for example, emulsifying and dispersing first resin particles produced by emulsion polymerization or the like in a solvent by using an ionic surfactant.

The colorant particle dispersion liquid is prepared by dispersing colorant particles having a color such as black, blue, red, or yellow in a solvent by using anionic surfactant having a polarity opposite that of the ionic surfactant used in the production of the resin particle dispersion liquid.

The release agent particle dispersion liquid is prepared by, for example, dispersing the release agent together with a polyelectrolyte such as an ionic surfactant, a polymer acid, or a polymer base in water, heating the dispersion liquid to a melting temperature or higher, and performing microparticulation using a homogenizer or a pressure discharge-type dispersing machine which may apply shear.

Next, the resin particle dispersion liquid, the colorant particle dispersion liquid, and the release agent particle dispersion liquid are mixed, and the first resin particles, the colorant particles, and the release agent particles are heteroaggregated to form aggregated particles (core-aggregated particles) having a desired toner particle size and including the first resin particles, the colorant particles, and the release agent particles.

In the second aggregation process, second resin particles are adhered to surfaces of the core-aggregated particles obtained in the first aggregation process by using a resin particle dispersion liquid including the second resin particles to form a covering layer (shell layer) having a desired thickness to thereby obtain aggregated particles (core/shell-aggregated particles) having a core/shell structure in which the shell layer is formed on the surfaces of the core-aggregated particles. At this time, the used second resin particles may be the same as, or different from the first resin particles.

In the first aggregation process, the balance between the amounts of the two polar ionic surfactants (dispersants) included in the resin particle dispersion liquid and the colorant particle dispersion liquid may be shifted in advance. For example, inorganic metallic salt such as calcium nitrate, or a polymer of inorganic metallic salt such as barium sulfate may be used, and this material may be ionically neutralized and heated at a temperature equal to or lower than the glass transition temperature of the first resin particles to produce the core-aggregated particles.

In this case, in the second aggregation process, a dispersion liquid of resin particles treated with a dispersant, the polarity and the amount which compensate the shift of the balance between the two polar dispersants as described above, is added to the solvent including the core-aggregated particles and heated at a temperature equal to or lower than the glass transition temperature of the core-aggregated particles or the second resin particles which are used in the second aggregation process, to produce core/shell-aggregated particles. The first and second aggregation processes may be divided into plural processes in a stepwise manner and repeatedly performed.

(2) Fusion Coalescence Process

Next, in the fusion coalescence process, the core/shell-aggregated particles obtained through the second aggregation process are heated to a temperature equal to or higher than the glass transition temperature (when there are two or more types of resins, the glass transition temperature of the resin having the highest glass transition temperature) of the first or second resin particles included in the core/shell-aggregated particles in the solvent, and fuse and coalesce to obtain toner particles.

After the fusion coalescence process ends, the toner particles formed in the solvent are subjected to a known washing process, a solid-liquid separation process, a drying process, and the like, and thus dried toner particles are obtained.

In the washing process, displacement washing is preferably sufficiently performed by ion exchange water from the viewpoint of chargeability. In addition, the solid-liquid separation process is not particularly limited, but suction filtration, pressure filtration or the like is preferably employed from the viewpoint of productivity. Furthermore, the drying process is also not particularly limited, freeze drying, flash jet drying, fluidized drying, oscillation-type fluidized drying, or the like is preferably employed from the viewpoint of productivity.

The volume average particle size of the toner particles is preferably from 3 μm to 7 μm, and more preferably from 3.5 μm to 6.5 μm.

In addition, the value of volume average particle size/number average particle size which is the indicator of the particle size distribution is preferably 1.6 or less, and more preferably 1.5 or less.

The volume average particle size (cumulative volume average particle size $D_{50}$) and the number average particle size (cumulative number average particle size $D_{50P}$) of the toner particles are measured using a Coulter Multisizer II (manufactured by Beckman Coulter, Inc.) with the use of an electrolyte ISOTON-II (manufactured by Beckman Coulter, Inc.).

In the measurement, a measurement sample is added to 2 ml of a 5 wt % aqueous solution of a surfactant (sodium alkylbenzene sulfonate is preferable) as a dispersant in an amount of from 0.5 mg to 50 mg. The resultant material is added to 100 ml to 150 ml of an electrolyte.

The electrolyte in which the sample is suspended is subjected to a dispersion process for 1 minute using an ultrasonic dispersing machine, and the particle size distribution of particles having a particle size of from 2 μm to 60 μm is measured by the Coulter Multisizer II using apertures having an aperture size of 100 μm. 50,000 particles are sampled.

Cumulative distributions are drawn from the smallest diameter side for the volume and the number with respect to particle size ranges (channels) divided on the basis of the particle size distribution measured as described above. The particle size corresponding to an accumulation of 50% is defined as a cumulative volume average particle size $D_{50v}$ and a cumulative number average particle size $D_{50P}$.

Production of Toner (External Addition of External Additive to Toner Particles)

At least one type of external additive selected from the metallic soap particles and the oil-treated inorganic particles is externally added by mixing with toner particles. The mixing is performed by a known mixer such as a V-blender, a Henschel mixer, or a Loedige Mixer.

At this time, various other additives may be externally added in combination. Examples of the other additives include a plasticizer, a cleaning aid such as polystyrene particles, polymethylmethacrylate particles, and polyvinylidene fluoride particles, a transfer aid, and the like.

Carrier

Next, a carrier will be described.

A carrier may be included in a developer which is accommodated in the developing device according to the exemplary embodiment. Examples of the carrier include a magnetic powder-dispersed carrier in which a magnetic powder is dispersed in a resin, a resin-covered carrier provided with a resin covering layer which covers the magnetic powder-dispersed carrier acting as a core, and the like.

Magnetic Powder-Dispersed Carrier

In the magnetic powder-dispersed carrier according to the exemplary embodiment, a magnetic powder is disposed in a resin.

Examples of the magnetic powder include magnetic metals such as iron, steel, nickel, and cobalt, alloys of the magnetic metals with manganese, chromium, rare-earth elements and the like (for example, a nickel-iron alloy, a cobalt-iron alloy, an aluminum-iron alloy, and the like), magnetic oxides such as ferrite and magnetite, and the like. Among them, iron oxide is preferable.

These magnetic powders may be used alone or in combination of two or more types.

The particle size of the magnetic powder is preferably from 0.01 μm to 1 μm more preferably from 0.03 μm to 0.5 μm, and even more preferably from 0.05 μm to 0.35 μm.

In addition, the content of the magnetic powder in the magnetic powder-dispersed carrier is preferably from 30 wt % to 99 wt %, more preferably from 45 wt % to 98 wt %, and even more preferably from 60 wt % to 98 wt %.

Examples of the resin component constituting the magnetic powder-dispersed carrier include crosslinked styrene-based resins, acryl-based resins, styrene-acryl-based copolymer resins, phenol-based resins, and the like.

In addition, the magnetic powder-disposed carrier may further contain other components. Examples of the other components include a charging control agent, fluorine-containing particles, and the like.

Known examples of the method of manufacturing the magnetic powder-dispersed carrier include a melting and kneading method (JP-B-59-24416 and JP-B-8-3679) in which a magnetic powder and an insulating resin such as a styrene-acrylic resin are melted and kneaded using a Banbury mixer, a kneader, or the like, cooled, and then pulverized and classified, a suspension and polymerization method (JP-A-5-100493, etc.) in which monomer units of a binder resin and a magnetic powder are dispersed in a solvent to prepare a suspension, and the suspension is polymerized, a spraying and drying method in which a magnetic powder is mixed and dispersed in a resin solution, and then sprayed and dried, and the like.

Any of the melting and kneading method, the suspension and polymerization method, and the spraying and drying method includes a process in which the magnetic powder is prepared in advance by a certain section and the magnetic powder is mixed with a resin solution to disperse the magnetic powder in the resin solution.

In addition, materials obtained by sintering metals such as iron, cobalt, and nickel, and alloys or compounds such as magnetite, hamatite, and ferrite, singly or in combination, and the like may also be used as known materials.

Resin Covering Layer

The carrier according to the exemplary embodiment may have a resin covering layer which covers the above-described magnetic powder-dispersed carrier acting as a carrier.

Regarding the resin covering layer, a known matrix resin is used as long as it may be used as a material of the resin covering layer for the carrier, and two or more types of resins may be blended and used.

Matrix resins constituting resin covering layers may be broadly divided into charging-imparting resins for imparting chargeability to a toner, and resins having low surface energy which are used to prevent migration of toner components (external additives and the like) to the carrier.

Here, examples of the charging-imparting resins for imparting negative chargeability to a toner include amino-based resins such as a urea-formaldehyde resin, a melamine resin, a benzoguanamine resin, a urea resin, a polyamide resin, and an epoxy resin. Furthermore, polyvinyl- and polyvinylidene-based resins, an acrylic resin, a polymethyl methacrylate resin, polystyrene-based resins such as a styrene-acrylic copolymer resin, a polyacrylonitrile resin, a polyvinyl acetate resin, a polyvinyl acetate resin, a polyvinyl alcohol resin, a polyvinyl butyral resin, cellulose-based resins such as an ethyl cellulose resin, and the like are also included.

In addition, examples of the charging-imparting resins for imparting positive chargeability to a toner include a polystyrene resin, halogenated olefin resins such as polyvinyl chloride, polyester-based resins such as a polyethylene terephthalate resin and a polybutylene terephthalate resin, polycarbonate-based resins, and the like.

Examples of the resins having low surface energy which are used to prevent migration of toner components to the carrier include a polyethylene resin, a polyvinyl fluoride resin, a polyvinylidene fluoride resin, a polytrifluoroethylene resin, a polyhexafluoropropylene resin, a copolymer of vinylidene fluoride and an acrylic monomer, a copolymer of vinylidene fluoride and vinyl fluoride, a terpolymer of tetrafluoroethylene, vinylidene fluoride and a non-fluoride monomer, a silicone resin, and the like.

In addition, conductive particles may also be added to the resin covering layer to adjust the resistance. Examples of the conductive particles include metallic powders, carbon black, titanium oxide, tin oxide, zinc oxide, and the like. As the conductive particles, plural types of conductive particles may be used in combination.

The content of the conductive particles in the resin covering layer is preferably from 1 wt % to 50 wt %, and more preferably from 3 wt % to 20 wt %.

In the exemplary embodiment, "conductive" means that the volume resistivity is $10^7$ Ωcm or less.

To measure the volume resistivity, a voltage of 100 V is applied according to JIS-K-6911 (1995) using a round electrode (UR PROBE of HIRESTA IP, manufactured by Mitsubishi Chemical Corporation: a cylindrical electrode having an external diameter of ϕ16 mm, a ring-shaped electrode part having an internal diameter of ϕ30 mm and an external diameter of ϕ40 mm) under the environment of 22° C./55% RH, and a current value 5 seconds after the application is measured using a microammeter R8340A manufactured by Advantest. The volume resistivity is obtained from a volume resistance according to the current value.

Furthermore, for charging control, resin particles may be contained in the resin covering layer. As a resin constituting the resin particles, a thermoplastic resin or a thermosetting resin is used.

In the case of the thermoplastic resin, examples thereof include polyolefin-based resins such as polyethylene and polypropylene; polyvinyl- and polyvinylidene-based resins such as polystyrene, an acrylic resin, polyacrylonitrile, polyvinyl acetate, polyvinyl alcohol, polyvinyl butyral, polyvinyl chloride, polyvinyl carbazol, polyvinyl ether, and polyvinyl ketone; vinyl chloride-vinyl acetate copolymers; styrene-acrylic acid copolymers; straight silicon resins constituted with an organosiloxane bond or modified products thereof; fluoride resins such as polytetrafluoroethylene, polyvinyl fluoride, polyvinylidene fluoride, and polychlorotrifluoroethylene; polyester; polycarbonate; and the like.

Examples of the thermosetting resin include a phenol resin; amino resins such as a urea-formaldehyde resin, a melamine resin, a benzoguanamine resin, a urea resin, and a polyamide resin; an epoxy resin; and the like.

The average thickness of the resin covering layer is preferably from 0.1 μm to 5 μm, more preferably from 0.3 μm to 3.0 μm, and even more preferably from 0.3 μm to 2.0 μm.

Method of Manufacturing Carrier

The method of manufacturing the carrier is not particularly limited, and known carrier manufacturing methods in the related art are used. However, the following manufacturing methods are preferable.

That is, examples thereof include a dipping method in which a resin covering layer forming solution (solution including a matrix resin which forms the resin covering layer, and as necessary, conductive particles, resin particles for charging control, and the like) is prepared and a core is dipped in the resin covering layer forming solution, a spraying method of spraying a resin covering layer forming solution to a surface of a core, a fluid bed method of spraying a resin covering layer forming solution in a state in which a core floats by flowing air, a kneader-coater method in which a core and a resin covering layer forming solution are mixed in a kneader-coater and then a solvent is removed, and the like. However, the method is not particularly limited to using a solution. For example, depending on the type of the core of the carrier, a powder application method in which a core and a resin powder are heated and mixed together, or the like may be employed. Furthermore, after formation of the resin covering layer, a heat treatment may be performed by a device such as an electric furnace, a kiln or the like.

In addition, the solvent which is used in the resin covering layer forming solution for forming the resin covering layer is not particularly limited as long as it dissolves the resin. Examples thereof include aromatic hydrocarbons such as xylene and toluene, ketones such as acetone and methyl ethyl ketone, ethers such as tetrahydrofuran and dioxane, halides such as chloroform and carbon tetrachloride, and the like.

The volume average particle size of the carrier is preferably from 25 μm to 100 μm, more preferably from 25 μm to 80 μm, and even more preferably from 25 μm to 60 μm.

Here, the volume average particle size of the carrier indicates a value measured using a laser diffraction/scattering-type particle size distribution measuring device (LS Particle Size Analyzer: LS13 320, manufactured by BECKMAN COULTER). A volume cumulative distribution is drawn from the smallest particle diameter side with respect to particle size ranges (channels) divided on the obtained particle size distribution, and the particle size corresponding to an accumulation of 50% of all the nuclei is defined as a volume average particle size $D_{50}$.

Operation

Next, the operation of the image forming apparatus according to the exemplary embodiment will be described.

In the image forming apparatus shown in FIG. 1, first, when each of the imaging engines 22 (22*a* to 22*d*) forms a single-color toner image corresponding to each color, the single-color toner images of the respective colors are primarily transferred onto the surface of the intermediate transfer belt 230 to sequentially overlap each other so as to be matched with the original information. Next, the color toner image transferred onto the surface of the intermediate transfer belt 230 is transferred onto a surface of a recording medium by the secondary transfer device 52, and the recording medium having the color toner image transferred thereonto is subjected to a fixing process by the fixing device 66, and then discharged to the paper discharger 68.

In the respective imaging engines 22 (22*a* to 22*d*), the toner remaining on the photoreceptor drum 31 is cleaned by the cleaning device 34.

In the exemplary embodiment, since the cleaning blade 342 of the cleaning device 34 satisfies the above-described requirements for the dynamic micro hardness and the tuck amount, the size of chips occurring in the cleaning blade is suppressed. Specifically, the size is suppressed to from 10 μm to 50 μm.

In addition, a toner which has an average particle size in the above-described range and to which an external additive selected from metallic soap particles and oil-treated inorganic particles is externally added is used as a toner which is accommodated in the developing device. When an external additive which satisfies the above requirements is applied with respect to chips having a size suppressed in the above range, toner slipping resulting from the chips of the cleaning blade is effectively suppressed, and favorable cleaning performance is obtained.

EXAMPLES

Hereinafter, the invention will be described using examples, but is not limited only to the examples. In the following description, "parts" is "parts by weight".

Example 1

Cleaning Blade A1

A cleaning blade A1 with a shape shown in FIG. 5 which has a contact member (edge member) and a non-contact member (rear member) is manufactured by a two-color molding method.

Provision of Mold

First, a first mold having a cavity (area in which a contact member forming composition flows) corresponding to a shape in which two contact members (edge members) overlap each other on the ventral surface side, and a second mold having a cavity corresponding to a shape in which two members, i.e., a contact member and a non-contact member (rear member) overlap each other on the ventral surface side are provided.

Formation of Contact Member (Edge Member)

First, polycaprolactone polyol (manufactured by Daicel Corporation, PLACCEL 205, average molecular weight: 529, hydroxyl value; 212 KOHmg/g) and polycaprolactone polyol (manufactured by Daicel Corporation, PLACCEL 240, average molecular weight: 4155, hydroxyl value: 270 KOHmg/g) are used as soft segment materials of a polyol component. In addition, an acrylic resin (manufactured by Soken Chemical Engineering Co., Ltd., Actflow UMB-2005B) including two or more hydroxyl groups is used as a hard segment material, and the soft segment materials and the hard segment material are mixed at a ratio of 8:2 (weight ratio).

Next, 6.26 parts of 4,4'-diphenylmethane diisocyanate (manufactured by Nippon Polyurethane Industry Co., Ltd., MILLIONATE MT) as an isocyanate compound is added with respect to 100 parts of the mixture of the soft segment materials and the hard segment material, and reacted for 3 hours at 70° C. under a nitrogen atmosphere. The amount of the isocyanate compound used in the reaction is selected so that a ratio (isocyanate group/hydroxyl group) of the isocyanate group to the hydroxyl group included in the reaction system is 0.5.

Next, the isocyanate compound is further added in an amount of 34.3 parts and reacted for 3 hours at 70° C. under a nitrogen atmosphere to obtain a prepolymer. The total amount of the isocyanate compound used in using the prepolymer is 40.56 parts.

Next, the prepolymer is heated to 100° C. and defoamed for 1 hour under a reduced pressure. Thereafter, 7.14 parts of a mixture of 1,4-butanediol and trimethylolpropane (weight ratio=60/40) is added with respect to 100 parts of the prepolymer and mixed therewith for 3 minutes so that bubbles are not formed, whereby a contact member forming composition A1 is prepared.

Next, the contact member forming composition A1 is allowed to flow to a centrifugal molding machine with the first mold adjusted to 140° C., and subjected to a hardening reaction for 1 hour. Next, crosslinking is performed for 24 hours at 110° C. and cooling is then performed to form a first molded product having a shape in which two contact members (edge members) overlap each other.

Formation of Non-Contact Member (Rear Member)

In a prepolymer generated by mixing and reacting diphenylmethane-4,4-diisocyanate with dehydrated polytetramethyl ether glycol for 15 minutes at 120° C., a material as a hardening agent in which 1,4-butanediol and trimethylolpropane are used in combination with each other is used as a non-contact member forming composition A1.

Next, the second mold is installed in the centrifugal molding machine so that the first molded product is disposed in the cavity of the second mold, and the non-contact member forming composition A1 is allowed to flow to the cavity of the second mold adjusted to 140° C., so as to cover the first molded product, and is subjected to a hardening reaction for 1 hour. Whereby, a second molded product having a shape in which two members, i.e., a contact member (edge member) and a non-contact member (rear member) overlap each other on the ventral surface side is formed.

After the formation of the second molded product, crosslinking is performed for 24 hours at 110° C. Next, the second molded product after the crosslinking is cut in a part which is to be a ventral surface, and further cut into dimensions of a length of 8 mm and a thickness of 2 mm. Whereby, a cleaning blade A1 is obtained.

Physical properties and the like of the cleaning blade A1 are as follows when being measured by the above-described method.

Dynamic Micro Hardness of Contact Member (Edge Member): 0.33

Impact Resilience at 10° C. of Non-Contact Member (Rear Member): 30%

Production of Toner Particles A1

Preparation of Crystalline Polyester Resin Particle Dispersion Liquid 1

Dimethyl Sebacate: 98 Parts

Dimethyl Isophthalate-5-sodium sulphonate: 2 Parts

Ethylene Glycol: 100 Parts

Dibutyltin Oxide (catalyst): 0.3 Parts

The above components are put in a heated and dried three-necked flask, and then a pressure reduction operation is performed to put the air in the container under an inert atmosphere by a nitrogen gas, and stirring and reflux are performed for 5 hours at 180° C. by mechanical stirring.

Thereafter, gradual heating to 230° C. is performed under a reduced pressure and stirring is performed for 2 hours. When the resultant material is viscous, air cooling is performed to stop the reaction, and thus a "crystalline polyester resin 1" is synthesized.

In the molecular weight measurement (polystyrene conversion) by gel permeation chromatography, the weight average molecular weight (Mw) of the obtained "crystalline polyester resin 1" is 9700, and the melting temperature is 85° C.

90 parts of the obtained "crystalline polyester resin 1", 1.8 parts of an ionic surfactant Neogen RK (Dai-ichi Kogyo Seiyaku Co., Ltd.), and 210 parts of ion exchange water are used and heated to 100° C. to be dispersed by an Ultra-turrax T50 manufactured by IKA. Then, the resultant mixture is subjected to a dispersion process for 1 hour by a pressure discharge-type Gaulin homogenizer, whereby a "crystalline polyester resin particle dispersion liquid 1" having a solid content of 20 parts is obtained.

Preparation of Amorphous Polyester Resin Particle Dispersion Liquid 1

Terephthalic Acid: 30 Parts

Fumaric Acid: 70 Parts

Bisphenol A-Ethylene Oxide 2 mol Adduct: 20 Parts

Bisphenol A-Propylene Oxide Adduct: 80 Parts

The above monomers are put in a flask with an internal capacity of 5 L which is provided with a stirring device, a nitrogen introduction tube, a temperature sensor, and a rectifying column, and the temperature is raised to 190° C. over 1 hour. After confirming that the materials are stirred without unevenness in the reaction system, 1.2 parts of dibutyltin oxide is charged therein.

Furthermore, while distilling away generated water, the temperature is raised from 190° C. to 240° C. over 6 hours and the dehydration synthesis reaction is continued for 3 hours at 240° C., whereby a "amorphous polyester resin 1" having an acid value of 12.0 mg/KOH, a weight average molecular weight (Mw) of 9700, and a glass transition temperature of 65° C. is obtained.

Next, while being in a melted state, the "amorphous polyester resin 1" is transferred to a Cavitron CD1010 (manufactured by Eurotec, Ltd.) at a speed of 100 g/min.

Diluted ammonia water having a concentration of 0.37 wt % in which reagent ammonia water is diluted with ion exchange water is put in a separately provided aqueous medium tank. While performing heating to 120° C. by a heat exchanger, the diluted ammonia water is transferred to the Cavitron CD1010 (manufactured by Eurotec, Ltd.) at a speed of 0.1 L/min with transfer of the "amorphous polyester resin 1".

The Cavitron CD1010 (manufactured by Eurotec, Ltd.) is operated under the conditions that a rotation speed of a rotor is 60 Hz and a pressure is 5 kg/cm$^2$, whereby an "amorphous polyester resin particle dispersion liquid 1" having a volume average particle size of 0.16 μm and a solid content of 30 parts and including the "amorphous polyester resin 1" is obtained.

Preparation of Colorant Particle Dispersion Liquid

Cyan Pigment (copper phthalocyanine B 15:3, manufactured by Dainichiseika Color & Chemicals Mfg. Co., Ltd.): 45 Parts Ionic Surfactant Neogen RK (Dai-ichi Kogyo Seiyaku Co., Ltd.): 5 Parts Ion Exchange Water: 200 Parts The above components are mixed, dissolved, and dispersed for 10 minutes by a homogenizer (Ultra-turrax manufactured by IKA), whereby a "colorant particle dispersion liquid" having a volume average particle size of 168 nm and a solid content of 22.0 parts is obtained.

Preparation of Release Agent Particle Dispersion Liquid

Paraffin Wax HNP9 (Melting Temperature 75° C.: manufactured by Nippon Seiro Co., Ltd.): 45 Parts Cationic Surfactant Neogen RK (Dai-ichi Kogyo Seiyaku Co., Ltd.): 5 Parts Ion Exchange Water 200 Parts The above components are heated to 95° C. and dispersed by an Ultra-turrax T50 manufactured by IKA. Then, a dispersion process is performed by a pressure discharge-type Gaulin homogenizer, whereby a "release agent particle dispersion liquid" having a volume average particle size of 200 nm and a solid content of 20.0 parts is obtained.

Production of Toner Particles A1

Amorphous Polyester Resin Particle Dispersion Liquid 1: 256.7 Parts

Crystalline Polyester Resin Particle Dispersion Liquid 1: 33.3 Parts

Colorant Particle Dispersion Liquid: 27.3 Parts

Release Agent Particle Dispersion Liquid: 35 Parts

The above components are mixed and dispersed by an Ultra-turrax T50 in a round flask made of stainless steel. Next, 0.20 parts of polyaluminum chloride is added thereto and the dispersion operation is continued by the Ultra-turrax T50. The flask is heated to 48° C. while being stirred by an oil bath for heating. The flask is held for 60 minutes at 48° C., and then 70.0 parts of the amorphous polyester resin particle dispersion liquid 1 is added thereto.

Thereafter, the pH in the system is adjusted to 9.0 with a sodium hydroxide aqueous solution of 0.5 mol/l, and then the flask made of stainless steel is sealed. While continuing the stirring using a magnetic seal, the flask is heated to 96° C. and held for 5 hours.

After the reaction ends, cooling, filtration, and washing with ion exchange water are performed, and then Nutsche-type suction filtration is performed for solid-liquid separation. The resultant material is dispersed again in 1 L of ion exchange water at 40° C., and then stirred and washed at 300 rpm for 15 minutes.

The Nutsche-type suction filtration and the re-dispersion in ion exchange water are repeated 5 times, and when the pH of the filtrate becomes 7.5 and the electrical conductivity becomes 7.0 μS/cm, solid-liquid separation is performed by Nutsche-type suction filtration using No. 5A filter paper. Next, vacuum drying is continued for 12 hours, and thus "toner particles A1" are obtained.

At this time, when measuring the particle size of the toner particles A1 by a Coulter counter, the volume average particle size D50 is 5.9 μm, and the volume average particle size distribution index GSDv is 1.24. In addition, the shape factor obtained by shape observation using LUZEX is 130.

Production of External Additive A1

Production of Oil-Treated Silica A1

A solution in which 50 parts of ethanol and 20 parts of a dimethyl silicone oil KF-96-065cs (Shin-Etsu Chemical Co., Ltd., kinetic viscosity at 25° C.: 0.65 $mm^2/s$) are mixed is produced and sprayed to 100 parts of hydrophilic silica Aerosil_OX50 (Nippon Aerosil) by spraydrying to perform a surface treatment on the silica particles. The ethanol is dried and removed at 80° C., and then a silicone oil treatment (sticking) is performed while performing stirring for 1 hour at 250° C. The silicone oil-treated silica is dissolved again in ethanol (ethanol treatment) to separate a free oil. Thereafter, drying is performed, and thus oil-treated silica A1 is obtained.

The volume average particle size of the oil-treated silica A1 is 0.2 μm, and a shape factor SF1 is 1.0.

Production of External Additive-Added Toner A1

Toner Particles A1: 100 Parts

Oil-Treated Silica A1: 2.0 Parts

Cerium Oxide (abrading agent, volume average particle size: 0.5 μm): 1.0 Parts

The above components are stirred for 10 minutes at 2500 rpm by a Henschel mixer, and thus an "external additive-added toner A1" is produced.

Production of Carrier

Ferrite Particles (average particle size: 50 μm, volume electrical resistance: $3\times10^8$ Ωcm): 100 Parts Toluene: 14 Parts Perfluorooctyl Ethyl Acrylate/Methyl Methacrylate Copolymer (copolymerization ratio 40:60, Mw=50,000): 1.6 Parts Carbon Black (VXC-72; manufactured by Cabot Corporation): 0.12 Parts Crosslinked Melamine Resin (number average particle size: 0.3 μm): 0.3 Parts Among the above components, the components excluding the ferrite particles are dispersed by a stirrer for 10 minutes to prepare a coating forming liquid. The coating forming liquid and the ferrite particles are put in a vacuum deaeration-type kneader and stirred for 30 minutes at 60° C. Then, the toluene is distilled away by reducing the pressure to form a resin coating film on surfaces of the ferrite particles, whereby a carrier is produced.

Production of Developer A1

4 parts of the external additive-added toner A1 and 96 parts of a carrier are stirred for 5 minutes by a V-blender, whereby a "developer A1" is produced.

Mounting on Image Forming Apparatus

DocuCentre-IV 05575 manufactured by Fuji Xerox Co., Ltd. is used as an image forming apparatus, and the cleaning blade A1 is mounted as a cleaning blade in a cleaning device for an image holding member (photoreceptor) of the image forming apparatus. The mounting conditions of the cleaning blade A1 are as follows.

Pressing Force NF (Normal Force) of Cleaning Blade against Image Holding Member: 1.5 gf/mm Length of Cleaning Blade Digging Deep into Image Holding Member: 1.0 mm Angle W/A (Working Angle) at Part in Which Cleaning Blade and Image Holding Member are Brought into Contact with Each Other: 12°

Tuck Amount of Cleaning Blade When Driving Image Holding Member: 0.02 mm

In addition, a developing device and a toner cartridge of the image forming apparatus are filled with the developer A1 and the external additive-added toner A1.

Evaluation Test: Occurrence of Chips

The following test is carried out to observe a degree (the size and the number of chips) of occurrence of chips in the cleaning blade A1 after the test. The cleaning blade A1 obtained in the example is mounted on DocuCentre-IV C5575 manufactured by Fuji Xerox Co., Ltd., and printing is performed on 10 k sheets of paper.

At that time, a level (grade) of occurrence of chips is evaluated through the size and the number of the chips in accordance with the following standard. The level (grade) of occurrence of chips is measured in a center site in an axial direction in the range of 100 mm.

Grade 10: None chips occurred

Grade 9: Chip size of 1 μm or less, from 1 to less than

Grade 8: Chip size of 1 μm or less, from 5 to less than

Grade 7: Chip size of 1 μm or less, 10 or more

Grade 6: Chip size of greater than 1 μm to 5 μm, from 1 to less than 5

Grade 5: Chip size of greater than 1 μm to 5 μm, from 5 to less than 10

Grade 4: Chip size of greater than 1 μm to 5 μm, 10 or more

Grade 3: Chip size of greater than 5 μm, from 1 to less than 5

Grade 2: Chip size of greater than 5 μm, from 5 to less than 10

Grade 1: Chip size of greater than 5 μm, 10 or more

Evaluation Test Toner Slipping Evaluation

The following test is carried out to evaluate a toner slipping level, that is, cleaning performance. The cleaning blade A1 obtained in the example is mounted on DocuCentre-IV C5575 manufactured by Fuji Xerox Co., Ltd., and printing is performed on 10 k sheets of paper.

At that time, 300 mm of an untransferred toner is introduced to evaluate a slipping level of the toner which remains on the surface of the photoreceptor after passing through the cleaning blade at the time of shutdown.

The evaluation standard is as follows.

A: None of Slipping

B: Several Slight Slipping Stripes

C: Several Tens of Slipping Stripes

D: Slipping in Almost Entire Surface in Axial Direction

Evaluation Results

The result of the evaluation on the occurrence of chips in the cleaning blade A1 obtained in Example 1 is "Grade 10". In addition, the result of the evaluation on toner slipping is "A".

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding member;

a developing device which accommodates a toner which contains at least one type of external additive having an average particle size of 0.02 μm or greater, selected from metallic soap particles and inorganic particles having an oil-treated surface, and toner particles having a surface with the external additive externally added thereto, and forms an image developed with the toner on a surface of the image holding member;

a transfer device which transfers the developed image formed on the image holding member onto a recording medium; and a cleaning device which is provided with a cleaning blade constituted by a member in which at least a part which is brought into contact with the image holding member has a dynamic micro hardness of from 0.25 to 0.65, in which a maximum length of an area which is brought into contact with the image holding member in a driving direction of the image holding member is from 1 μm to 300 μm, and brings the cleaning blade into contact with the surface of the image holding member after transfer of the developed image by the transfer device to perform cleaning.

2. A process cartridge which is detachable from an image forming apparatus, comprising:

an image holding member;

a developing device which accommodates a toner which contains at least one type of external additive having an average particle size of 0.02 μm or greater, selected from metallic soap particles and inorganic particles having an oil-treated surface, and toner particles having a surface with the external additive externally added thereto, and forms an image developed with the toner on a surface of the image holding member; and a cleaning device which is provided with a cleaning blade constituted by a member in which at least a part which is brought into contact with the image holding member has a dynamic micro hardness of from 0.25 to 0.65, in which a maximum length of an area which is brought into contact with the image holding member in a driving direction of the image holding member is from 1 μm to 300 μm, and brings the cleaning blade into contact with the surface of the image holding member after transfer of the developed image onto a recording medium to perform cleaning.

* * * * *